US006597883B2

(12) United States Patent
Muramatsu et al.

(10) Patent No.: US 6,597,883 B2
(45) **Date of Patent: *Jul. 22, 2003**

(54) POWDER PUMP CAPABLE OF EFFECTIVELY CONVEYING POWDER AND IMAGE FORMING APPARATUS USING POWDER PUMP

(75) Inventors: Satoshi Muramatsu, Kanagawa (JP); Nobuo Iwata, Kanagawa (JP); Nobuo Kasahara, Kanagawa (JP); Junichi Matsumoto, Kanagawa (JP); Tomoyuki Ichikawa, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/073,237

(22) Filed: Feb. 13, 2002

(65) Prior Publication Data

US 2002/0164178 A1 Nov. 7, 2002

(30) Foreign Application Priority Data

Feb. 13, 2001 (JP) ..... 2001-036231

(51) Int. Cl.[7] ..... G03G 15/00; G03G 15/08

(52) U.S. Cl. ..... 399/258; 222/DIG. 1; 399/260; 399/359

(58) Field of Search ..... 399/258, 260, 399/262, 359; 222/DIG. 1, 167

(56) References Cited

U.S. PATENT DOCUMENTS

| | | | | |
|---|---|---|---|---|
| 4,835,582 | A | 5/1989 | Kasahara et al. | 399/167 |
| 4,908,661 | A | 3/1990 | Iwata et al. | 399/116 |
| 4,954,849 | A | 9/1990 | Koike et al. | 399/402 |
| 4,975,749 | A | 12/1990 | Tsunoda et al. | 399/374 |
| 4,979,727 | A | 12/1990 | Koike et al. | 271/3.03 |
| 5,008,711 | A | 4/1991 | Sakamoto et al. | 399/24 |
| 5,014,091 | A | 5/1991 | Koike et al. | 399/405 |
| 5,162,859 | A | 11/1992 | Hirono et al. | 399/54 |
| 5,386,274 | A | 1/1995 | Sanpe et al. | 399/101 |
| 5,663,788 | A | 9/1997 | Sanpe | 399/353 |
| 5,875,380 | A | 2/1999 | Iwata et al. | 399/301 |
| 5,953,567 | A | 9/1999 | Muramatsu et al. | 399/256 |
| 5,962,783 | A | 10/1999 | Iwata et al. | 73/488 |
| 5,987,298 | A | 11/1999 | Muramatsu et al. | 399/359 |
| 6,112,046 | A | 9/2000 | Suzuki et al. | 399/359 |
| 6,122,468 | A | 9/2000 | Sakamoto et al. | 399/223 |
| 6,128,459 | A | 10/2000 | Iwata et al. | 399/301 |
| 6,142,690 | A | 11/2000 | Yoshimura et al. | 400/636.2 |
| 6,163,669 | A | 12/2000 | Aoki et al. | 399/159 |
| 6,201,941 | B1 | 3/2001 | Kasahara et al. | 399/258 |
| 6,249,304 | B1 | 6/2001 | Sawayama et al. | 347/228 |
| 6,282,396 | B1 | 8/2001 | Iwata et al. | 399/301 |
| 6,295,437 | B1 | 9/2001 | Hodoshima et al. | 399/346 |
| 6,308,027 | B1 | 10/2001 | Obu et al. | 399/110 |
| 6,381,435 | B2 | 4/2002 | Shinohara et al. | 399/301 |
| 6,393,241 | B1 | 5/2002 | Matsumoto et al. | 399/258 |

FOREIGN PATENT DOCUMENTS

| | | |
|---|---|---|
| JP | 11-84873 | 3/1999 |
| JP | 2000-162874 | 6/2000 |
| JP | 2001-034054 | 2/2001 |

*Primary Examiner*—Sophia S. Chen
(74) *Attorney, Agent, or Firm*—Oblon, Spivak, McClelland, Maier & Neustadt, P.C.

(57) ABSTRACT

A powder pump includes a stator having a through hole that includes two spirally extended grooves, and a rotor, which is rotatably provided to the through hole of the stator and is spirally extended such that a cavity to convey a powder is formed between an outer peripheral surface of the rotor and an inner peripheral surface of the through hole of the stator. The rotor is configured to convey the powder enclosed in the cavity while moving the cavity. The expressions ((RA−SN) ≧0.45) and ((RB−(SN+SX)/2)≧0.45) are satisfied when a diameter of a cross section of the rotor, an outer diameter of the rotor, a minimum inner diameter of the through hole of the stator, and a maximum inner diameter of the through hole are in millimeters and represented by RA, RB, SN, and SX, respectively.

60 Claims, 14 Drawing Sheets

POWDER PUMP CAPABLE OF EFFECTIVELY CONVEYING POWDER AND IMAGE FORMING APPARATUS USING POWDER PUMP

CROSS-REFERENCE TO RELATED APPLICATIONS

This application claims priority to Japanese Patent Application No. 2001-036231 filed on Feb. 13, 2001. This application is also related to U.S. application Ser. No. 09/987,027 filed on Nov. 13, 2001. The entire contents of both applications are herein incorporated by reference.

BACKGROUND OF THE INVENTION

1. Field of the Invention

The present invention relates to a powder pump to be used in an image forming apparatus, such as a copying machine, a facsimile, a printer, and other similar devices, and more particularly to a powder pump that can effectively convey a powder.

2. Discussion of the Background

A powder pump that conveys various types of powders is commonly known. For example, in an image forming apparatus such as a copying machine, a facsimile, a printer, and a multifunctional image forming apparatus having at least two of the above-described functions, a powder pump is used to convey toner or a two-component developer including toner and a carrier (for example, in Japanese Patent Laid-Open Publication No. 11-84873). Generally, such a powder pump is referred to as a uniaxial eccentricity screw pump or Moineau pump.

The above-described powder pump is configured such that a cavity, which is formed between an outer peripheral surface of a rotor and an inner peripheral surface of a through hole of a stator, moves according to a rotation of the rotor. Thus, a powder enclosed in the cavity is conveyed. Generally, the rotor is formed of a rigid member, such as metal or resin, and the stator is formed of a elastic material, such as rubber or soft resin, for example.

Hermeticity of the cavity is enhanced to increase a suction force of a powder pump so that an amount of a powder to be conveyed per unit of time is increased. An outer peripheral surface of a rotor (which is more rigid than the stator) is in press-contact with an inner peripheral surface of a through hole of a stator, which is formed of an elastic member. The press-contacting rotor elastically deforms the inner peripheral surface of the through hole of the stator, hereafter referred to as the deformation of the stator. In order to enhance the hermeticity of the cavity, the deformation of the stator is increased, thereby increasing the press-contacting force of the rotor portion and the stator portion around the cavity.

However, if the stator excessively deforms, problems such as increased rotor torque cause wear on the stator, and the temperature of the powder pump 1 is increased due to friction produced between the rotor and stator arises. Thus, if a powder conveyed by the powder pump is one that is easily influenced by heat, the powder may be adversely affected by an increase in the temperature of the powder pump. For example, if the powder is toner or a two-component developer having toner and a carrier, the toner tends to coagulate by the increase in the temperature of the powder pump.

SUMMARY OF THE INVENTION

The present invention has been made in view of the above-mentioned and other problems and addresses the above-discussed and other problems.

The present invention advantageously provides a novel powder pump in which a powder is effectively conveyed while minimizing the above-described difficulties.

According to an example of present invention, the powder pump includes a stator having a through hole comprised of two spirally extended grooves and a rotor, which is rotatably provided to the through hole of the stator and is spirally extended such that a cavity to convey a powder is formed between an outer peripheral surface of the rotor and an inner peripheral surface of the through hole of the stator. The rotor is configured to convey the powder enclosed in the cavity while moving the cavity. The following equations illustrate a non-limiting embodiment of the present invention:

$$RA-SN \geqq 0.45$$

and $RB-(SN+SX)/2 \geqq 0.45$, or $-0.18 \leqq RB-(SN+SX)/2-(RA-SN) \leqq 0.16$ or $RA-SN \geqq 0.4$, $RB-(SN+SX)/2-(RA-SN) \leqq 0.12$, and $-0.18 \leqq RB-(SN+SX)/2-(RA-SN) \leqq 0.12$, or (4) $RA-SN \geqq 0.5$ and $RB-(SN+SX)/2 \geqq 0.5$, and $-0.18 \leqq RB-(SN+SX)/2-(RA-SN) \leqq 0.12$, or $0.9 \leqq SN/2SR \leqq 0.95$, where a diameter of a cross section of the rotor, an outer diameter of the rotor, a minimum inner diameter of the through hole of the stator, a maximum inner diameter of the through hole, a radius of each groove of the through hole of the cross section of the stator are in millimeters and represented by RA, RB, SN, SX, and SR, respectively.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
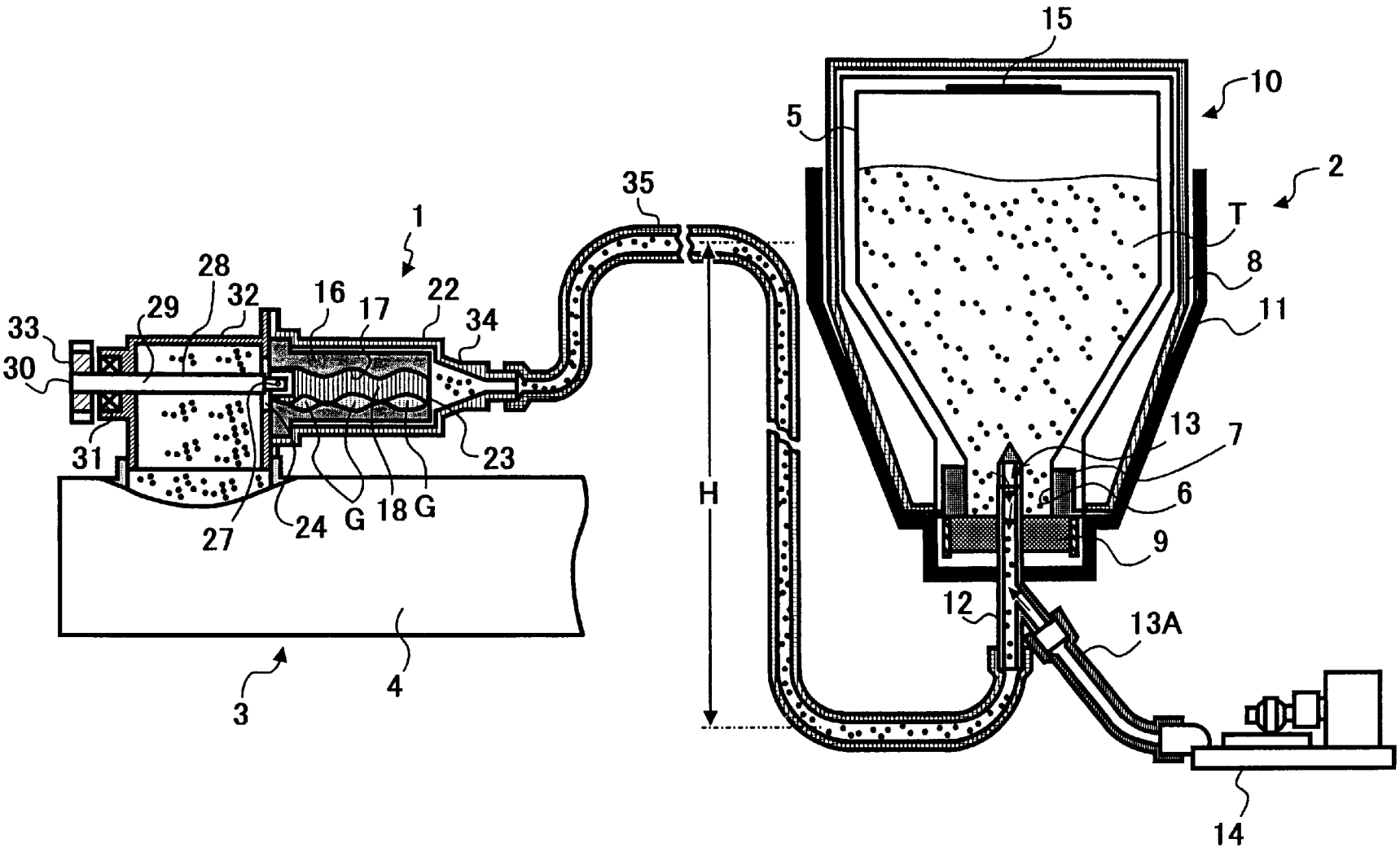
FIG. 1 is a schematic drawing illustrating a toner conveying device and a powder pump that conveys toner from a toner container to a developing device.

Referring now to the drawings, wherein like reference numerals designate identical or corresponding parts throughout the several views, an illustrative embodiment of the present invention is described below with reference to the figures.

FIG. 1 is a schematic drawing illustrating a powder pump 1, toner T (which is an example of a powder conveyed by the powder pump 1), a toner containing device 2 (which contains the toner T), and a developing device 3, which are used in an image forming apparatus, such as a copying machine, a printer, a facsimile, or a multifunctional image forming apparatus that includes at least two of the above-described functions. A developer container 4 in the developing device 3 contains a two-component developer in a powder (not shown) that includes toner and carrier. A toner image is formed on the surface of an image bearing member (not shown) with the toner in the developer. When a toner density detecting sensor (not shown) detects that a toner density of a developer contained in the developer container 4 has decreased, the powder pump 1 conveys the toner T contained in the toner containing device 2 to the developer container 4. A construction of the toner containing device 2 illustrated in FIG. 1 is described below.

The toner containing device 2 includes a bag-shaped toner container 5 having an opening in the lower portion thereof. The toner T is contained in the toner container 5. The lower portion of the toner container 5 (which is on the side of an opening 6) is fixedly supported by a supporting member 7 and contained in a protection case 8. A lower portion of the protection case 8 is fixed to the supporting member 7. A sealing member 9 formed of an elastic member such as a sponge is fixedly supported by the supporting member 7. A toner cartridge 10 is integrally constructed with the toner container 5, protection case 8, supporting member 7, and sealing member 9. The toner cartridge 10 is attachable to and detachable from a holder 11 that is fixed to the main body of an image forming apparatus.

Figure 2:
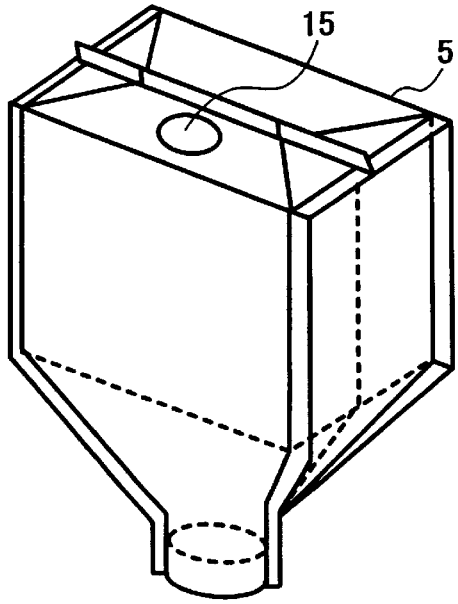
FIG. 2 is a schematic drawing illustrating a perspective view of the toner container.

The toner container 5 is formed of a hermetic member in the form of a monolayer or bilayer structure. For example, a flexible sheet made of a resin, such as polyethylene and nylon or a paper having a thickness of about 80 to about 200 $\mu$m is used in the form of a bag. The toner container 5 is assembled while unfolding a folded hermetic member as illustrated in FIG. 2. The protection case 8 is, for example, formed of a paper, a card board or a plastic having rigidity. The supporting member 7 is formed of a resin or a paper.

The toner containing device 2 includes a toner discharging tube 12. When the toner cartridge 10 is placed inside the holder 11, an upper portion of the toner discharging tube 12 is inserted into the sealing member 9 through a slit formed in the sealing member 9. Thus, a toner discharging outlet 13 formed at one end of the toner discharging tube 12 goes inside the toner container 5. At this time, the sealing member 9 adheres to the circumferential surface of the toner discharging tube 12 by its elasticity, thereby preventing the toner T from leaking out of the toner container 5.

An air supply tube 13A is connected to the toner discharging tube 12. Air pumped by an air pump 14 is supplied to the toner container 5 from the toner discharging outlet 13 through the air supply tube 13A and toner discharging outlet 12. With this arrangement, the powdery toner T in the toner container 5 is stirred so that the toner T easily flows, thereby preventing a reduction of efficiency of discharging the toner T due to a cross-linkage of the toner T.

As illustrated in FIG. 2, a filter 15 is provided on the top surface of the toner container 5. Air passes through the filter 15 while toner is filtered out. When air is supplied to the toner container 5 as described above, the air is discharged through the filter 15, thereby preventing an excessive pressure increase in the toner container 5.

Figure 3:
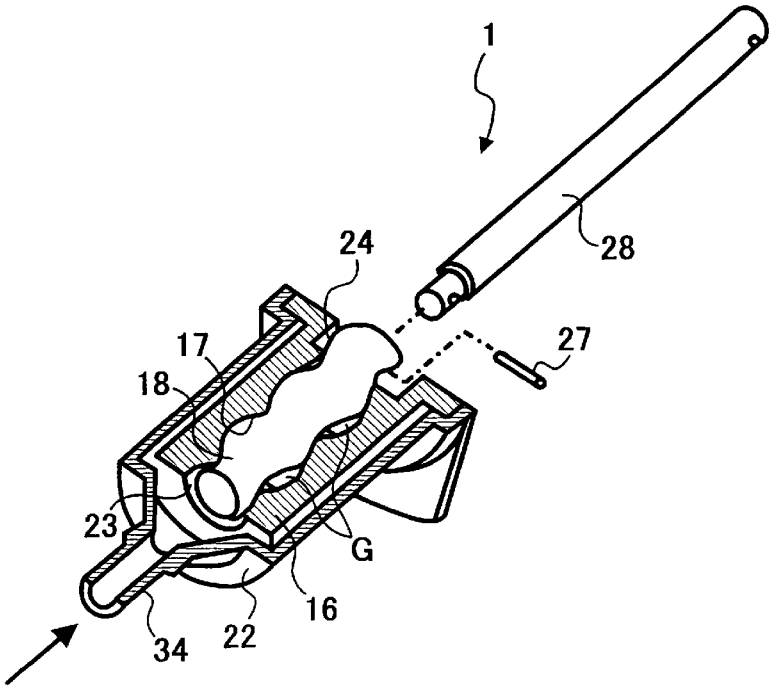
FIG. 3 is a drawing illustrating a sectional view of the powder pump illustrated in FIG. 1.

As illustrated in FIG. 3, the powder pump 1 includes a stator 16 and a rotor 18. The rotor 18 rotatably provided to through hole 17 formed in the stator 16. The stator 16 is made of a material that is more elastic than that of the rotor 18. For example, the stator 16 is made of an elastic member such as rubber while the rotor 18 is made of a rigid member, such as a metal or resin.

Figure 4:
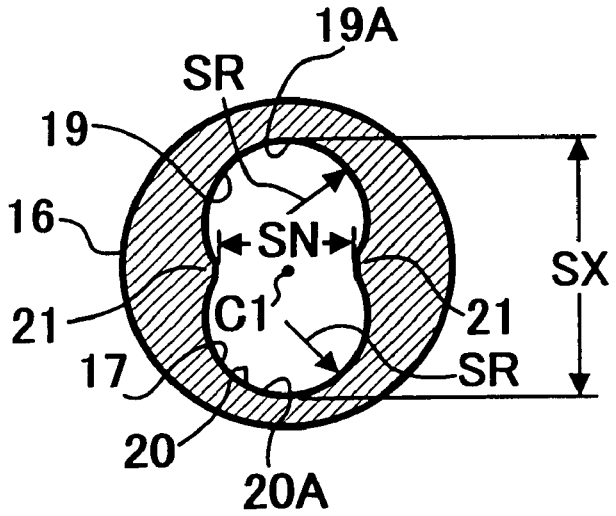
FIG. 4 is a drawing illustrating a lateral sectional view of a stator.
Figure 5:
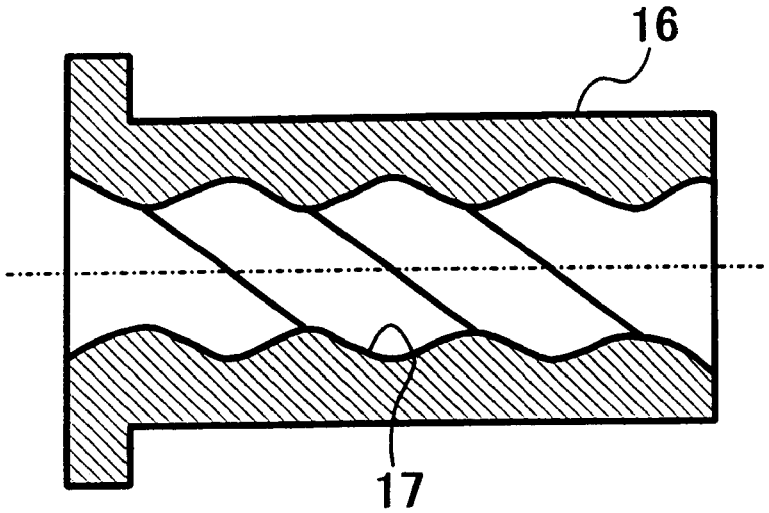
FIG. 5 is a drawing illustrating a longitudinal sectional view of the stator.
Figure 6:
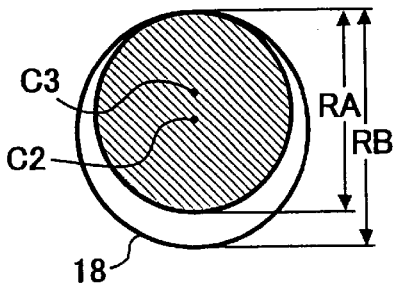
FIG. 6 is a drawing illustrating a lateral sectional view of a rotor.
Figure 7:
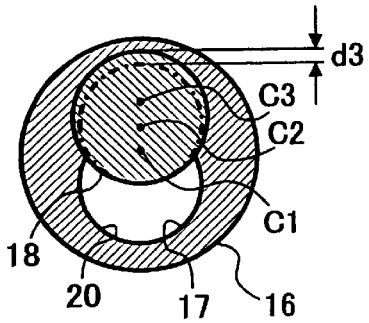
FIG. 7 is a drawing illustrating a lateral sectional view of the stator in which the rotator is inserted into a through hole of the stator.
Figure 8:
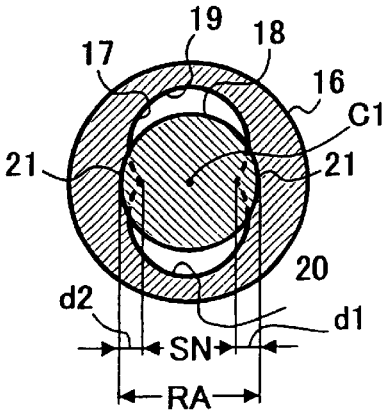
FIG. 8 is a drawing illustrating a lateral sectional view of the stator in which the rotator is inserted into a through hole of the stator.

FIG. 4 is a drawing illustrating a lateral sectional view of the stator 16 in which the rotor 18 is not inserted into the through hole 17 of the stator 16. FIG. 5 is a drawing illustrating a longitudinal sectional view of the stator 16 in which the rotor 18 is not inserted into the through hole 17 of the stator 16. FIG. 6 is a drawing illustrating a lateral sectional view of the rotor 18. FIGS. 7 and 8 are drawings illustrating a lateral sectional view of the stator 16 in which the rotor 18 is inserted into the through hole 17 of the stator 16. The lateral sectional view shows a sectional view that is cut in a direction perpendicular to the axis of the stator 16. The longitudinal sectional view shows a sectional view that is cut in a direction along the axis of the stator 16.

As illustrated in FIGS. 4 and 5, the through hole 17 of the stator 16 includes two grooves 19 and 20 that spirally extend around a central axis line C1. The grooves 19 and 20 have a curved shape. As illustrated in FIG. 4, two grooves 19 and 20, which are formed into the curved shape, have identical radii. A boundary of the grooves 19 and 20 becomes constricted. It is preferable that a stator portion 21, which divides the boundary, is formed in a round shape. However, through hole 17 may be configured into other shapes. For example, the through hole 17 may be configured to have an elliptical sectional shape without constricting the boundary of both grooves 19 and 20 (see FIG. 18).

As illustrated in FIGS. 3 and 6, the rotor 18 spirally extends around a central axis line C2 such that a cavity G, through which a powder is conveyed, is formed between an outer peripheral surface of the rotor 18 and an inner peripheral surface of the through hole 17. Any sectional view of the rotor 18 is round-shaped. A center C3 of the round shaped sectional view of the rotor 18 is eccentric about the central axis line C2 of the rotor 18. The rotor 18 spirally extends around the central axis line C2. The rotor 18 having a spiral structure is wrapped up in the stator 16 such that the rotor 18 engages and contacts with the stator 16. The stator 16 is retained in a case 22. The above-described powder pump including the rotor 18 and stator 16 is referred to as a uniaxial eccentricity screw pump or Moineau pump, which is commonly known.

Toner is conveyed from an inlet opening 23 of the through hole 17 (see FIG. 1) to an outlet opening 24 thereof. Hereinafter, an end of the rotor 18 on the side of the outlet opening 24 is referred to as an end of an outlet of the rotor 18. A connecting shaft 28 is connected to the end of the outlet of the rotor 18 through a universal joint including a pin joint 27. The connecting shaft 28 is also connected to a driving shaft 30 through a pin joint 29. The driving shaft 30 is rotatably supported by a casing 32 through a bearing 31. A gear 33 is fixed to a portion of the driving shaft 30 that protrudes from the casing 32. A gear (not shown) engages with the gear 33. A rotation of a driving motor (not shown) is transmitted to the driving shaft 30 and connecting shaft 28 via these gears. Thus, the rotor 18 is rotatably driven. The casing 32 is connected to the case 22.

One end of a toner conveying tube 35 is connected to a powder inlet tube 34 that is provided to an end of the case 22 which is opposed to the other end of the case 22 where the connecting shaft 28 is disposed. For example, the toner conveying tube 35 is made of a flexible tube. The other end of the toner conveying tube 35 is connected to the other end of the toner discharging tube 12. The toner conveying tube 35 is, for example, made of a flexible tube having an internal diameter of about 4 mm to about 7 mm. The flexible tube may include rubber materials, such as polyurethane, nitrile, EPDM (i.e., ethylene-propylene-diene-methylene), silicone, and/or plastic materials, such as polyethylene and nylon.

A lower part of the casing 32 is connected to the developer container 4 of the developing device 3 such that interiors of the casing 32 and developer container 4 are communicated with each other. As described above, when the toner density detecting sensor in the developing device 3 detects that a toner density of a tow-component developer contained in the developer container 4 is decreased, the driving motor rotatably drives the driving shaft 30 and connecting shaft 28. Then, the rotor 18 rotates about the center C3 (see FIGS. 6 and 7) of the curved sectional view. The central axis line C2 of the rotor 18 rotates while having a circular locus around the central axis line C1 of the through hole 17 of the stator 16. A illustrated in FIGS. 7 and 8, the rotor 18 travels between the grooves 19 and 20 that divide the through hole 17 of the stator 16 while each circular cross section of the rotor 18 rotates. With the rotation of the rotor 18, the cavity G formed between an outer peripheral surface of the rotor 18 and an inner peripheral surface of the through hole 17 moves in the direction of left in FIG. 1. Thus, a suction force is generated in the side of the inlet opening 23 of the through hole 17, namely in a toner intake side of the powder pump 1.

The suction force generated by the rotation of the rotor 18 of the powder pump 1 is transmitted to the toner T contained in the toner container 5 through the toner conveying tube 35 and toner discharging tube 12. Thus, the toner T in the toner conveying tube 35 is conveyed from the inlet opening 23 of the through hole 17 to the cavity G such that the toner T is conveyed in the direction of left in FIG. 1. The toner T is then discharged into the casing 32 through the outlet opening 24 of the through hole 17. As described above, the cavity G having the toner T moves with the rotation of the rotor 18 to convey the toner T from the inlet opening 23 of the through hole 17 to the outlet opening 24 thereof.

The toner T discharged from the through hole 17 of the stator 16 is then conveyed to the developer container 4 where the toner T is stirred and mixed with a two-component developer contained in the developer container 4. The rotation of the rotor 18 stops after a predetermined time has elapsed. With the above-described toner supply, a toner density of a developer contained in the developer container 4 is maintained in a predetermined range. Thus, a toner image having a predetermined density is formed on a surface of an image bearing member.

Because air is supplied to the toner T in the toner container 5 from the air pump 14 to improve fluidity of the toner T, an occurrence of a cross-linkage phenomenon of the toner T is prevented. Thus, the toner T is stably supplied, thereby minimizing an amount of the toner T left in the toner container 5.

As described above, the powder pump 1 is configured such that the rotor 18 (which is more rigid than the stator 16) is in press-contact with an inner peripheral surface of the through hole 17 of the stator 16 that is formed of an elastic member. The press-contacting rotor 18 elastically deforms the inner peripheral surface of the through hole 17 to enclose each cavity G. Thus, the toner T enclosed in the cavity G is conveyed. It is useful that hermeticity of the cavity G is enhanced and a suction force of the powder pump 1 is increased so as to increase an amount of toner to be conveyed per unit of time.

Figure 9:
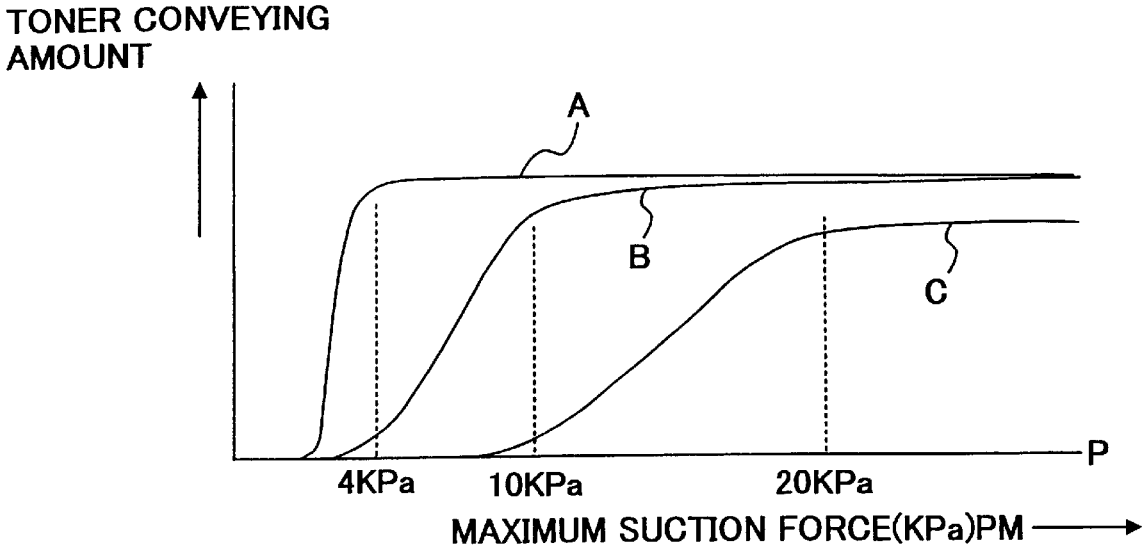
FIG. 9 is a graph illustrating a relationship between a maximum suction force of the powder pump and its conveying amount of toner.
Figure 10:
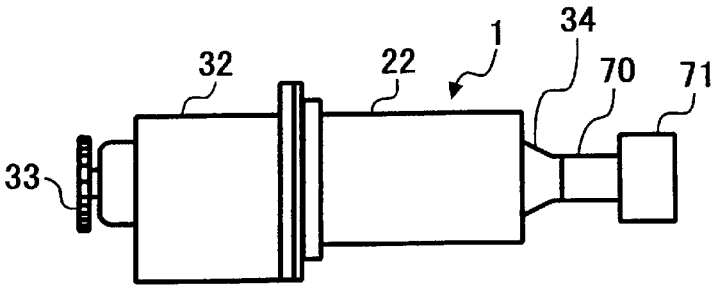
FIG. 10 is a drawing explaining the maximum suction force.

FIG. 9 is a graph illustrating an experimental result that shows a relationship between a maximum suction force PM in the toner suction side of the powder pump 1 and a toner conveying amount per unit of time. The maximum suction force PM is a gauge pressure measured in the following manner. Namely, as illustrated in FIG. 10, a pressure gauge 71 is connected to the powder inlet tube 34 of the case 22 via a tube 70 instead of the toner conveying tube 35 illustrated in FIG. 1. An internal pressure of the enclosed tube 70 is then measured by the pressure gauge 71 while rotating the rotor 18. Thus, the maximum suction force PM is a suction force in the maximum load of the powder pump 1.

A plurality of powder pumps 1 that have a different level of hermeticity of the cavity G are produced such that each powder pump 1 has a different suction force. FIG. 9 is the graph showing an amount of toner conveyed per unit of time by each of the powder pump 1 under conditions described below. In FIG. 9, the horizontal axis shows the maximum suction force PM of each powder pump 1, and the vertical axis shows a toner conveying amount per unit of time. Actually, the maximum suction force PM is a negative force. However, the maximum suction force PM is indicated at an absolute value in FIG. 9. Similarly, the maximum suction force PM is indicated at the absolute value in the following description.

A, B, and C in FIG. 9 respectively represent different types of toner having different uplifted distances H (see FIG. 1). H represents a distance in which the toner conveyed in the toner conveying tube 35 is uplifted. Fluidity of toner differs according to an amount of an external additive, such as silica gel and titanium, and a type of resinoid included in a toner particle. The fluidity of toner also differs according to an environmental temperature and humidity where the powder pump 1 is used. As illustrated in FIG. 9, the toner conveying amount is not increased to a maximum value when a level of the maximum suction force PM is low. This indicates that the powder pump 1 does not stably convey toner due to an insufficient maximum suction force PM, resulting in a decrease in an average toner conveying amount.

In FIG. 9, A represents an experimental result when toner that has comparatively good fluidity (which is used in an image forming apparatus) is used. The degree of coagulation of the toner is in the range of about 5% to about 20%. The uplifted distance H is set to 200 mm. Under the above-described conditions, the toner is stably conveyed. As illustrated in FIG. 9, with the above-described toner, a conveyance of the toner is started when the powder pump 1 that has the maximum suction force PM of approximately 3 KPa is used. The toner conveying amount is increased to the maximum level and the toner is stably conveyed when the maximum suction force PM of the powder pump 1 is equal to 4 KPa or larger (i.e., PM≧4 KPa). Thus, the expression: PM≧4 KPa is referred to as a first condition.

B in FIG. 9 represents an experimental result when toner that is identical to the toner A is used. However, the experiment is performed under the condition that the uplifted distance H is 500 mm. A load imposed in conveying the toner is increased compared to the load in conveying the toner in the experiment A because the uplifted distance H is set longer in the case of the experiment B. Thus, although the toner can be conveyed when the maximum suction force PM satisfies a expression: 4 KPa≦PM<10 KPa, the toner is not stably conveyed due to a loss of the force caused until the suction force of the powder pump 1 is transmitted to the toner contained in the toner container 5. The toner conveying amount is increased to the maximum level and the toner is stably conveyed when the maximum suction force PM of the powder pump 1 is equal to 10 KPa or larger (i.e., PM≧10 KPa). Thus, the expression: PM≧10 KPa is referred to as a second condition.

The toner cartridge 10 in FIG. 1 is replaced with a new one when the toner T contained in the toner container 5 is exhausted or the amount of the remaining toner T becomes small. It is not preferable that the toner cartridge 10 is disposed of where the level T is substantially lower than a position where the developing device 3 is located. Generally, the uplifted distance H is set equal to 500 mm or smaller in an image forming apparatus. Thus, toner is stably conveyed to the developing device 3 when the above-described second condition is satisfied.

C in FIG. 9 represents an experimental result when toner having inferior fluidity is used. The degree of coagulation of the toner is in the range of about 20% to about 60%. The experiment is performed under the condition that the uplifted distance H is set to 500 mm. The experiment C is performed under the most difficult condition among the experiments A, B, and C in terms of replenishing the developing device 3 with toner. Thus, the largest loss of the suction force results in a conveyance of the toner in experiment C. The toner conveying amount is increased to the maximum level and the toner is stably conveyed when the powder pump 1 having the maximum suction force PM equal to 20 KPa or larger (i.e., PM≧20 KPa). The expression PM≧20 KPa is referred to as a third condition. Thus, when the powder pump 1 is configured to satisfy the third condition, toner is stably conveyed to the developing device 3 even under the most difficult condition for conveying the toner.

The above-described degree of coagulation of toner is measured using three sieves having a mesh size of 150 μm, 75 μm, and 45 μm, respectively (i.e., a first, second, and third sieve, respectively). The first sieve is placed in the uppermost position. The second sieve is placed beneath the first sieve. The third sieve is placed beneath the second sieve (i.e., in the lowermost position). These sieves are vibrated for about 20 seconds while placing toner of 2 g in the first sieve. An amount of toner remaining in the first, second, and third sieve is referred to as x(g), y(g), and z(g), respectively. Thus, the degree of coagulation of the toner is a value obtained by the following calculation: $(5x+3y+z\times10(\%)$.

If the powder pump 1 is configured to satisfy one of the above-described three conditions according to a type of toner used and the uplifted distance H, any type of toner is stably conveyed to replenish the developing device 3 with toner. To satisfy one of the above-described conditions, a press-contacting force of a rotor portion with a stator portion around the cavity G is increased such that hermeticity of the cavity G is enhanced. Thus, the stator portion substantially deforms to enhance the hermeticity of the cavity G. However, if the stator 16 excessively deforms, problems such as increased torque on the rotor 18, a decrease in the life of the stator 16 due to increased abrasion, and an increase in temperature of the powder pump 1 arise.

Figure 11:
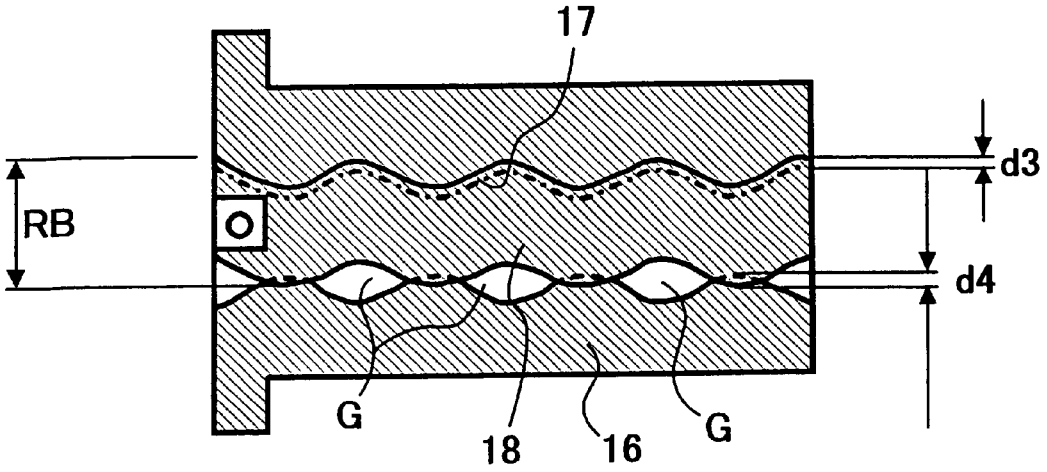
FIG. 11 is a drawing illustrating a longitudinal sectional view of the rotor and stator.

FIG. 11 is a drawing illustrating an enlarged sectional view of the stator 16 and rotor 18 of the powder pump 1. A dotted line illustrated in FIGS. 7, 8, and 11 indicates the shape of the stator 16 before the stator 16 is deformed by the rotor 18. As illustrated in FIGS. 8 and 11, a diameter of the circular cross section of the rotor 18 and a maximum outer diameter of the outer peripheral surface of the rotor 18 that spirally extends are referred to as RA(mm) and RB(mm), respectively. A minimum inner diameter of the through hole 17, namely, the inner diameter of the through hole 17 in the boundary of grooves 19 and 20 is referred to as SN(mm) (see FIG. 8). A maximum inner diameter of the through hole 17, namely, a distance between the bottom of grooves 19 and 20 is referred to as SX(mm) (see FIG. 4). A value of SN and SX represent respective inner diameters of the through hole 17 when the rotor 18 is not inserted into the through hole 17.

In FIG. 8, the rotor 18 is positioned between the grooves 19 and 20. Each stator portion 21 that divides the boundary of the grooves 19 and 20 deforms when pressed by the rotor 18. An amount of the deformation of each stator portion 21 is referred to as d1 and d2 as illustrated in FIG. 8. A value of the sum total of d1 and d2 is calculated by the expression: (RA−SN)mm. D1 denotes the sum total of d1 and d2 (i.e., RA−SN), which is referred to as a deformed amount of the stator portion 21 in cross section.

As illustrated in FIGS. 7 and 11, an amount of a bottom portion of the grooves 19 and 20 deformed when the upper portion of the rotor 18 is in press-contact with the bottom portion of the grooves 19 and 20 with the largest force is referred to as d3 (see FIG. 7). An amount of the stator portion 21 deformed when an upper portion of the rotor 18 is in press-contact with the stator portion 21 with the largest force is referred to as d4 (see FIG. 11). A value of the sum total of d3 and d4 is calculated by an expression: (RBmm−(SNmm+SXmm)/2). D2 denotes the value thus obtained which is referred to as a deformed amount of the outer diameter.

Hermeticity of each cavity G is determined by the deformed amount of the stator portion 21 that surrounds each cavity G (i.e., D1), deformed amount of the outer diameter (i.e., D2), and deformed amount of a portion of the stator 16 other than the above-described portions. As a result of many experiments performed by the inventor, the inventor confirmed that D1 and D2 are the largest factors to determine the hermeticity of the cavity G.

Figure 12:
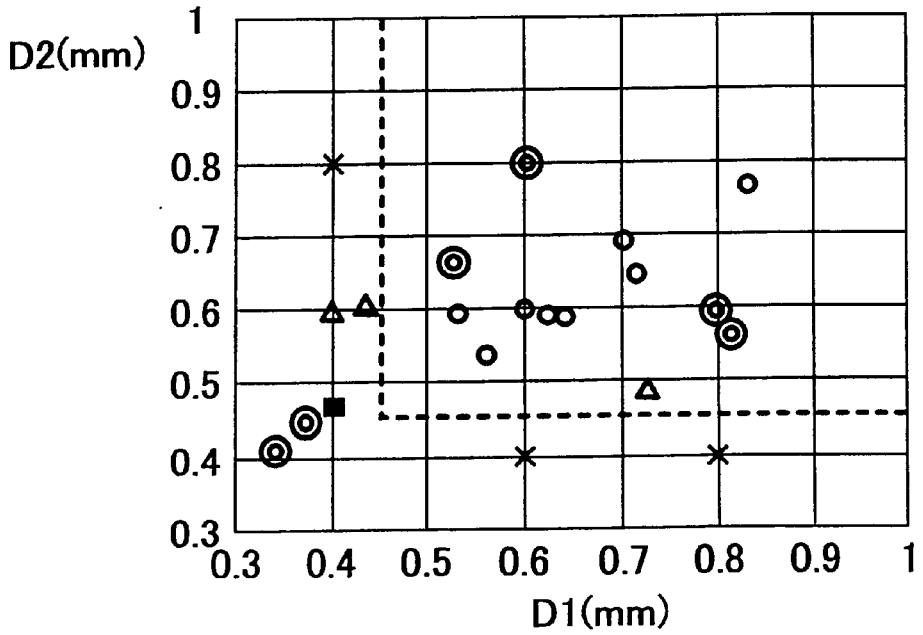
FIG. 12 is a graph illustrating a relationship between a deformed amount of the stator portion in cross section and a deformed amount of an outer diameter, and the maximum suction force.

FIG. 12 is a graph illustrating an experimental result that shows a relationship between D1 and D2, and the maximum suction force PM in the toner suction side of the powder pump 1. FIGS. 13 to 16 shows the identical experimental result. In the experiment, the rotor 18 made of aluminum and the rubber stator 16 made of EPDM (i.e., ethylene-propylene-diene-methylene) are used. The rubber stator 16 has a hardness of 50-degree in Japanese Industrial Standards A. The maximum suction force PM of the powder pumps 1 is measured while varying the D1 and D2 values. A rotational frequency of the rotor 18 is 200 rpm. The number of threads of the rotor 18 (hereinafter referred to as a pitch number of the rotor 18) counted along the axis direction of the rotor 18 is four. As illustrated in FIG. 4, a radius of each groove 19 and 20 when the rotor 18 is not inserted into the through hole 17 is represented by SR. A minimum inner diameter SN of the through hole 17 and the SR are set to values in which a ratio of SN to two times of SR (i.e., SN/2SR) becomes 0.94.

Marks indicated in FIGS. 12 to 16 show a range of the maximum suction force PM of the powder pump 1. Namely, "○": (PM≧30 Kpa), "■": (20 KPa≦PM<30 Kpa),"502 ": (10 KPa≦PM<20 Kpa)," ": (4 PKa≦PM<10 Kpa), and "x": (PM<4 Kpa). Each value is an absolute value of the maximum suction force PM.

Hence, in order to satisfy the above-described first condition i.e., (PM≧4 Kpa), respective values of D1 and D2 are set such that the maximum suction force PM is in a range other than a range marked with "x", namely in a range enclosed with a dotted line in FIG. 12. RA, RB, SN, and SX are respectively set to values that satisfy the expressions: (D1=RA−SN≧0.45) and (D2=RB−(SN+SX)/2≧0.45). With the above-described configuration, the powder pump 1 achieves the maximum suction force PM of not less than 4 KPa (i.e., PM≧4 KPa) that is required to stably convey toner under the condition in which the experiment A shown in FIG. 9 is performed. The above-described example is referred to as a first example of the present invention.

Figure 13:
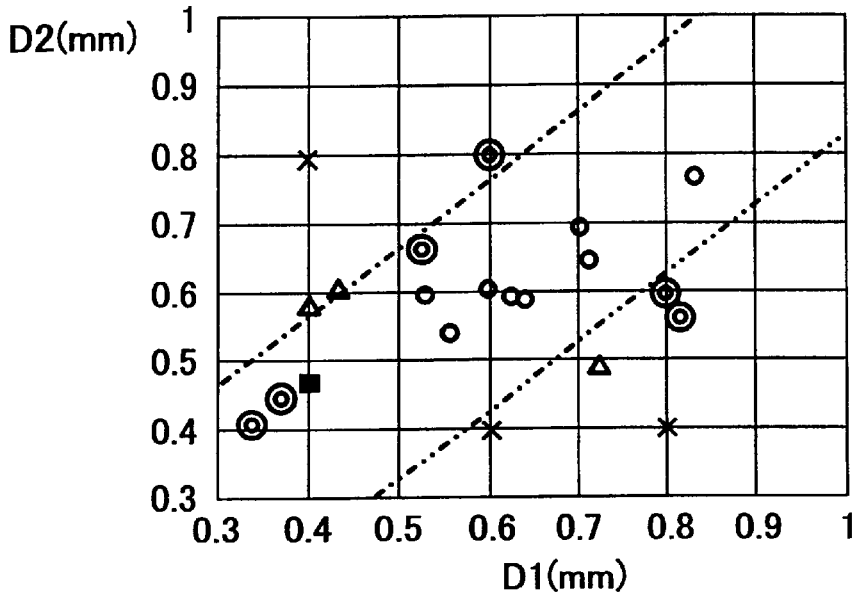
FIG. 13 is a graph illustrating the relationship between the deformed amount of the stator portion in cross section and the deformed amount of an outer diameter, and the maximum suction force.

In order to satisfy the above-described second condition i.e., PM≧10 KPa, respective values of D1 and D2 are set such that the maximum suction force PM is in a range other than ranges marked with "x" and "Δ", namely in a range between the dashed lines in FIG. 13. RA, RB, SN, and SX are respectively set to values that satisfy the expression: (−0.18≦((RB−(SN+SX)/2−(RA−SN))≦0.16). This means that D1 and D2 are set to approximately equal values. With the above-described configuration, the powder pump 1 achieves the maximum suction force PM of not less than 10 KPa (i.e., PM≧10 KPa) that is required to stably convey toner under the condition in which the experiment B shown in FIG. 9 is performed. The above-described example is referred to as a second example of the present invention.

Figure 14:
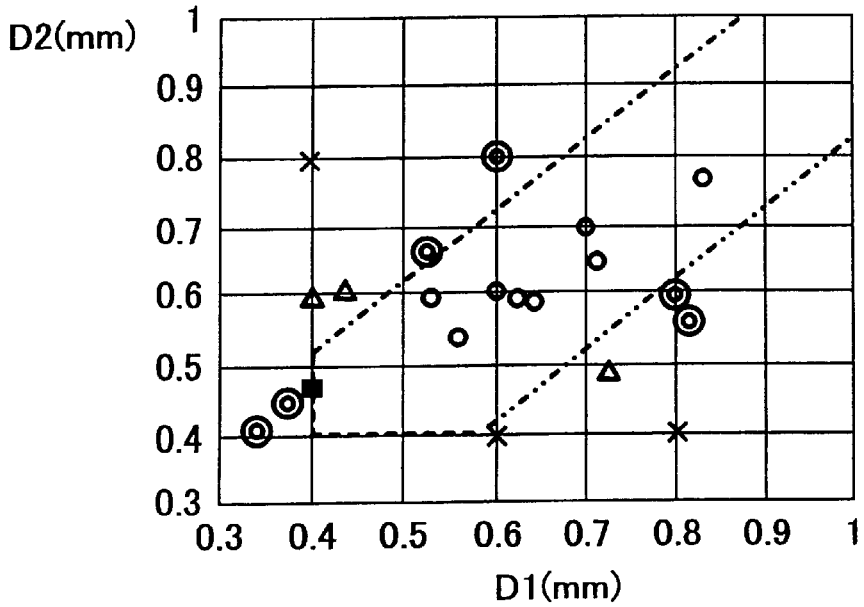
FIG. 14 is a graph illustrating the relationship between the deformed amount of the stator portion in cross section and the deformed amount of an outer diameter, and the maximum suction force.

In order to satisfy the above-described third condition i.e., (PM≧20 Kpa), respective values of D1 and D2 are set such that the maximum suction force PM is in a range marked with "○" and "■", namely in a range enclosed between the dashed and dotted lines in FIG. 14. RA, RB, SN, and SX are respectively set to values that satisfy the expressions: ((RA−SN)≧0.4), ((RB−(SN+SX)/2)≧0.4), and (−0.18(≦RB−(SN+SX)/2−(RA−SN)≦0.12). With the above-described configuration, the powder pump 1 achieves the maximum suction force PM of not less than 20 KPa (i.e., PM≧20 KPa) that is required to stably convey toner under the condition in which the experiment C shown in FIG. 9 is performed. The above-described example is referred to as a third example of the present invention.

Figure 15:
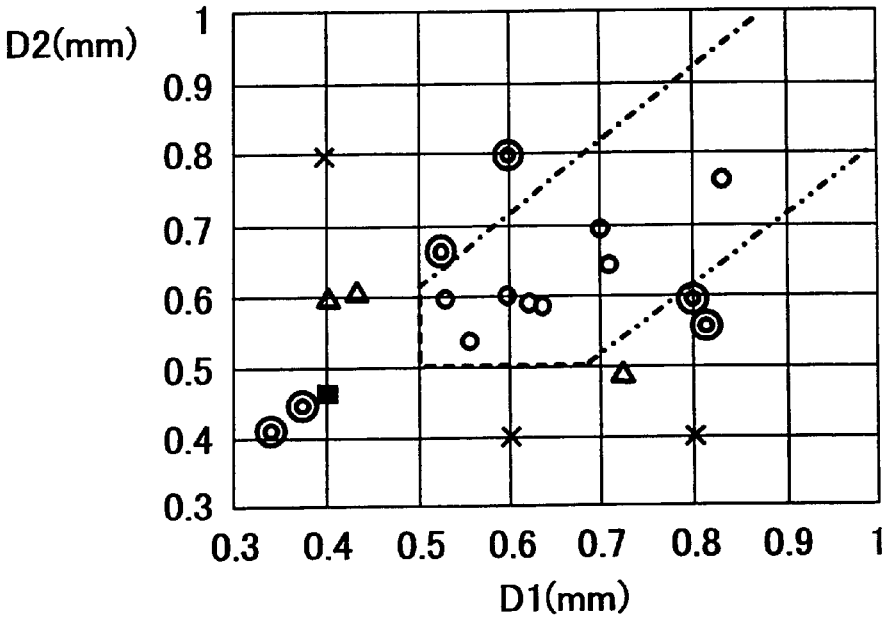
FIG. 15 is a graph illustrating the relationship between the deformed amount of the stator portion in cross section and the deformed amount of an outer diameter, and the maximum suction force.

In addition, respective values of D1 and D2 may be set such that the maximum suction force PM is in a range marked with "○", namely, in a range enclosed between the dotted and dashed lines in FIG. 15. RA, RB, SN, and SX are respectively set to values that satisfy the expressions: ((RA−SN)≧0.5), ((RB−(SN+SX)/2)≧0.5), and (−0.18(≦RB−(SN+SX)/2−(RA−SN))≦0.12). With the above-described configuration, the powder pump 1 gets the maximum suction force PM of not less than 30 KPa (i.e., PM≧30 KPa) to stably convey even toner that has inferior fluidity. The above-described example is referred to as a fourth example of the present invention.

FIGS. 12 through 16 show a relationship among D1, D2, and the maximum suction force PM of new powder pump 1. When D1 and D2 are set to large values, the hermeticity of the cavity G is enhanced. Thus, the powder pump 1 achieves maximum suction force PM. However, if the maximum suction force PM is excessively increased, friction produced between the inner peripheral surface of the through hole 17 of the stator 16 and the rotor 18 becomes large. Thus, wear of the stator 16 is prompted and results in a decreased lifetime of the stator 16.

Figure 17:
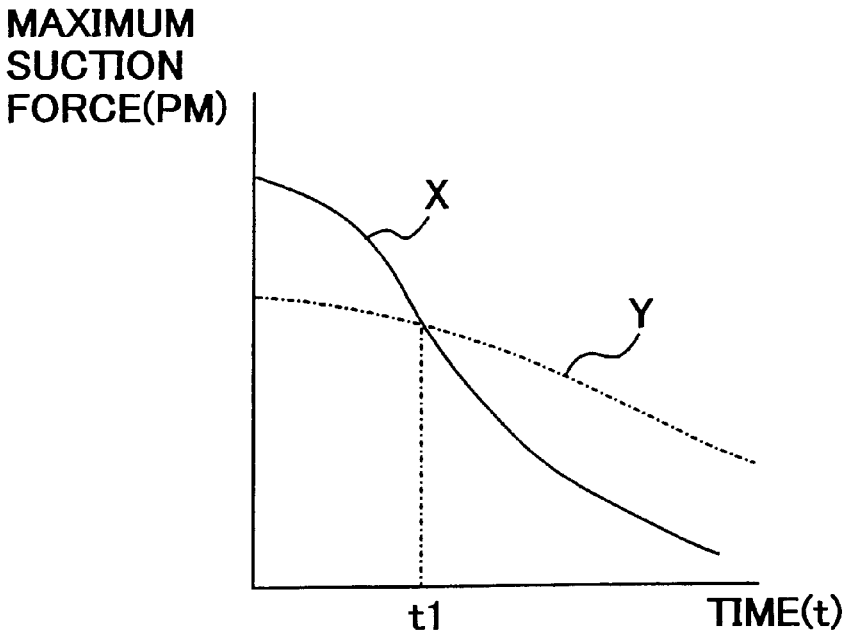
FIG. 17 is a graph illustrating a relationship between the maximum suction force and an operation time of the powder pump.

FIG. 17 is a graph explaining the above-described difficulty. The vertical line and horizontal line represent the maximum suction force PM and the time of operation "t" of the powder pump 1, respectively. A solid line X indicates a change in the maximum suction force PM with respect to time when the powder pump 1, in which both values of D1 and D2 are set to 1 mm, is used. A chained line Y indicates a change in the maximum suction force PM with respect to time when the powder pump 1, in which both values of D1 and D2 are set to 0.7 mm, is used. In the beginning of use of the powder pump 1, the maximum suction force PM of the powder pump 1 marked with X is larger than that of the powder pump 1 marked with Y. However, the maximum suction force PM of the powder pump 1 marked with Y becomes larger than that of the powder pump 1 marked with X at the time t1. It is proven that the maximum suction force PM of the powder pump 1 marked with X drastically decreases in a short period of time, resulting in a decreased lifetime of the stator 16.

Thus, it is preferable that RA, RB, SN, and SX are respectively set to values that satisfy the expression: RA−SN≦0.9, and RB−(SN+SX)/2≦0.9. The above-described example is referred to as a fifth example of the present invention.

Figure 16:
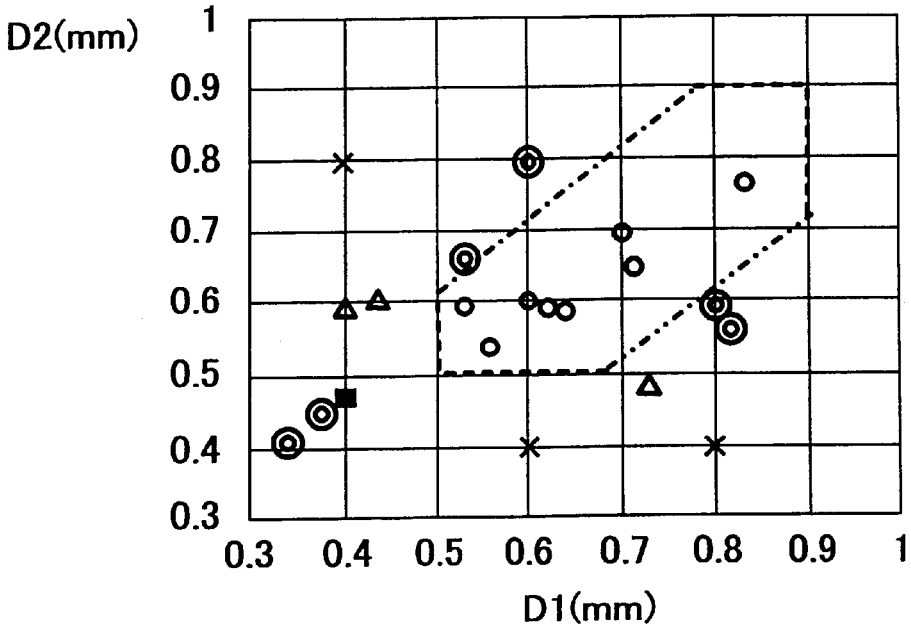
FIG. 16 is a graph illustrating the relationship between the deformed amount of the stator portion in cross section and the deformed amount of an outer diameter, and the maximum suction force.

In order to apply the fifth example to the fourth example, respective values of D1 and D2 are set such that the maximum suction force PM is in a range enclosed by the dashed and dotted lines in FIG. 16. Namely, RA, RB, SN, and SX are respectively set to values that satisfy the expressions: $(0.5 \leqq (RA-SN) \leqq 0.9)$, $(0.5 \leqq (RB-(SN+SX)/2) \leqq 0.9)$, and $(-0.18 \leqq (RB-(SN+SX)/2-(RA-SN)) \leqq 0.12)$.

With the configuration described in the fifth example, the powder pump 1 stably conveys toner, resulting in an extended lifetime of the powder pump 1.

In the above-described first through fifth examples, the stator 16 is not excessively deformed by the rotor 18. Values of D1 and D2 that have a large effect on the hermeticity of the cavity G are appropriately set so that the powder pump 1 can stably convey a maximum amount of toner per unit of time while preventing a decrease in life time of the powder pump 1.

When actually setting values of D1, D2, and D2–D1, it is preferable to set them to the most appropriate values considering the following conditions. These features include, but are not limited to: a property of toner used, the uplifted distance H, a toner conveying distance (i.e., from the toner container 5 to the powder pump 1 in the case of FIG. 1), required operation time of the powder pump 1, and a use environment of the powder pump 1 (for example, a temperature inside an image forming apparatus).

As described above, friction is produced between the rotor 18, formed of a rigid member, and the inner peripheral surface of the through hole 17 of the stator 16, which is formed of an elastic member, when the powder pump 1 is activated and the rotor 18 is rotated. However, the inner peripheral surface of the through hole 17 does not experience uniform wear. Larger friction is produced between the rotor 18 and the stator portion 21 compared to the friction produced between the rotor 18 and a bottom 19A and 20A of the grooves 19 and 20 (see FIG. 4). Thus, wear of the stator portion 21 is prompted. Hence, if the stator 16 is constructed such that hermeticity of the cavity G is maintained at a high level even if the stator portion 21 wears out, the maximum suction force PM is maintained at a high level even if the powder pump 1 is operated for a long period of time. In addition, lifetime of the powder pump 1 is increased.

Figure 18:
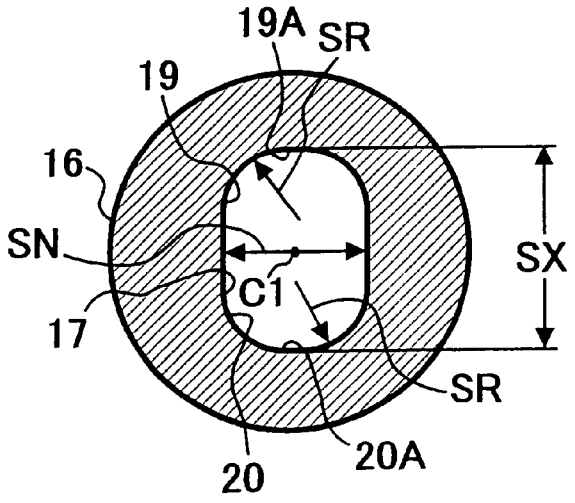
FIG. 18 is a drawing illustrating a lateral sectional view of a stator that is configured differently from the stator illustrated in FIG. 4.

The through hole 17 may be formed such that a boundary portion of the grooves 19 and 20 becomes constricted as illustrated in FIG. 4 or it may be formed in an oval-shape as illustrated in FIG. 18. However, it is more advantageous to have the above-described effect if the through hole 17 is formed in the shape illustrated in FIG. 4. Each stator portion 21 illustrated in FIG. 4 protrudes toward the other stator portions. Thus, the hermeticity of the cavity G is maintained at a high level even if the stator portion 21 wears out in some degree over the period of use of the powder pump 1.

As described above referring to FIG. 4, SR (mm) represents a radius of grooves 19 and 20 in cross-section and SN (mm) represents a minimum inside diameter of the through hole 17 when the stator 16 is not elastically deformed. Thus, if the through hole 17 is formed in an oval-shape as illustrated in FIG. 18, the expression (SN=2SR) is satisfied. If the through hole 17 is formed in the shape illustrated in FIG. 4, the expression (SN<2SR) is satisfied. Thus, if the through hole 17 of the stator 16 is constructed to satisfy the expression (SN<2SR), the maximum suction force PM of the powder pump 1, in which the stator is incorporated, is maintained at a high level even if the powder pump 1 is used for a long time.

Based on the above-described knowledge, an experiment is performed on a conveyance of toner using the powder pumps 1 having each stator A to F in which a value of (SN/2SR) is set as indicated in Table 1. The powder pump 1 is then incorporated into an image forming apparatus as illustrated in FIG. 1. A hardness of rubber in Table 1 indicates a hardness of each stator A to F in Japanese Industrial Standard A. The maximum suction force PM of the powder pump 1 before use of the powder pump 1, and the maximum suction force PM after the powder pump 1 is operated for 50 hours are indicated in Table 1. In this experiment, a suction force of the powder pump 1 is measured, however, a discharging force of the powder pump 1 may be measured.

The experiment is performed under the condition that (1) (RA–SN=0.6), (2) ((RB–(SN+SX)/2)=0.6), (3) rotational frequency of the rotor 18 is set to 200 rpm, (4) the number of pitch of the rotor 18 is set to four, and (5) a diameter of the rotor 18 in cross section (i.e., RA) is set to 7 mm. The material of the rotor 18 is zinc base alloy, and the material of the stator 16 is EPDM (i.e., ethylene propylene-diene-methylene) rubber.

A mark "○" indicated in the judgment column in Table 1 shows that the maximum suction force PM is equal to 10 KPa or larger, which satisfies the above-described second condition. A mark " " indicated in the judgment column shows that the maximum suction force PM is 4 to 10 KPa, which satisfies the above-described first condition. A mark "x" indicated in the judgment column shows that the maximum suction force PM is less than 4 KPa, which satisfies neither the above-described first nor second conditions.

As can be seen from the result of the judgment in Table 1, the maximum suction force PM is kept at a high level for a long period of time, hermeticity of the cavity G is kept at a enhanced level, and an amount of toner to be conveyed per unit of time is increased when the through hole 17 of the stator 16 before use of the powder pump 1 is configured to satisfy the expression ((SN/2SR)<1). These results are compared to the through hole 17 configured to satisfy the expression ((SN/2SR)=1). Namely, the lifetime of the powder pump 1 is extended when the through hole 17 is shaped to have a constricted portion (i.e., the stator portion 21) as illustrated in FIG. 4, compared to the through hole 17 having an elliptical sectional shape that is illustrated in FIG. 18.

In addition, it is very important to realize from the stator F in Table 1 that the maximum suction force PM decreases with respect to a period of use of the powder pump 1 if the value of (SN/2SR) is set excessively small. The result is that a decrease in the maximum suction force PM is prevented even if the powder pump 1 is used for a long period of time and a lifetime of the powder pump 1 is extended, if the values of SN and SR are set to satisfy the expression $(0.9 \leqq SN/2SR \leqq 0.95)$.

Thus, it is preferable to construct the powder pump 1 to satisfy the above-described expression and any one of the first to fifth examples described above.

It has been confirmed by an experiment performed by the inventor that the maximum suction force PM of the powder pump 1 varies according to materials of the stator 16 and rotor 18, a hardness of the stator 16, a rotational frequency of the rotor 18, and a pitch number of the rotor 18 in addition to the above-mentioned conditions. Thus, it is preferable that the values of D1, D2, and D2–D1 are set considering the above-described conditions.

Tables 2 to 4 show the results of the above-described experiments performed by the inventor. In the experiments, both values of D1 and D2 of the powder pump 1 are set to 0.6 mm. The pitch number and the diameter of the cross section of the rotor 18 (i.e., RA) are set to four and 7 mm, respectively. In addition, the values of SN and SR are set to satisfy the expression: ((SN/2SR)=0.94).

Table 2 shows a result of the experiment performed to examine a change in the maximum suction force PM according to a material of the rotor 18. The maximum suction force PM of a new powder pump 1 is measured in early stages of use and after the powder pump 1 is operated for 30 hours. In the experiment, the rotational frequency of the rotor 18 is set to 200 rpm. The stator 16 is made of EPDM (i.e., ethylene-propylene-diene-methylene) rubber. In addition, the rotor 18 including the POLYCARBONATE TEFLON (registered trade name) coating is used.

Table 3 shows a result of the experiment performed to examine a change in the maximum suction force PM according to a material and hardness of the stator 16. The maximum suction force PM of a new powder pump 1 is measured in early stages of use and after the powder pump 1 is operated for 30 hours. In the experiment, the rotational frequency of the rotor 18 is set to 200 rpm. The rotor 18 made of polycarbonate is used. The hardness indicated in Table 3 is based on Japanese Industrial Standards A.

In the judgment columns in Tables 2 and 3, the mark "○" indicates that the maximum suction force PM of the powder pump 1 is equal to 10 KPa or larger when the maximum suction force PM is measured both in early stages of use of the powder pump 1 and after the powder pump 1 is operated for 30 hours. The mark "" indicates that the maximum suction force PM satisfies the expressions (4 KPa≦PM<10 KPa), when the maximum suction force PM is measured both in early stages of use of the powder pump 1 and after the powder pump 1 is operated for 30 hours. The mark "x" indicates that the maximum suction force PM is less than 4 KPa when the maximum suction force PM is measured in the manner similar to that of above described. Namely, the mark "○" shows that the above-described second condition is satisfied. The mark "Δ" shows that the above-described first condition is satisfied. The mark "x" shows that neither first nor second conditions are satisfied.

As can be seen from the result of the judgment in Table 2, rotors made of materials other than ABS resin and ABS resin with Ni plating are judged as being good. In the above-described powder pump 1 described referring to first to fifth examples and Table 1, if the rotor 18 is formed of aluminum, polycarbonate, or polyacetal resin, or if the rotor 18 is formed of one of these materials as a main material, a high level of the maximum suction force PM is maintained when the maximum suction force PM is measured both in early stages of use of the powder pump 1 and after the powder pump 1 is operated for 30 hours, resulting in a stable conveyance of a large amount of toner.

As can be seen from the result of the judgement in Table 3, 1, the stator 16, which is formed of EPDM rubber or chloroprene rubber having a hardness of 40 or 50-degree, is judged as being good. Thus, in each of the above-described powder pumps 1, if the stator 16, which is formed of EPDM rubber or chloroprene rubber having the hardness of 40 or 50-degree in Japanese Industrial Standards A, or if the stator 16 is formed of one of these two materials as a main material, a high level of the maximum suction force PM is maintained when the maximum suction force PM is measured both in early stages of use of the powder pump 1 and after the powder pump 1 is operated for 30 hours, resulting in a stable conveyance of a large amount of toner.

The above-described EPDM rubber and chloroprene rubber has an increased abrasion resistance. In addition, because the hardness of EPDM rubber and chloroprene rubber is less than or equal to 50-degree in Japanese Industrial Standard A, the repulsive force of the stator 16 as it is pressed and deformed by the rotor 18 decreases. Thus, an abrasion of an inner peripheral surface of the through hole 17 is suppressed. Hence, a high level of the maximum suction force PM is maintained even after the powder pump 1 is operated for a long period of time. However, when the stator 16 is made of natural rubber having a hardness of 40-degree in Japanese Industrial Standards A, the maximum suction force PM is 0 KPa when measured after the powder pump 1 is operated for 30 hours. Thus, it has been confirmed that the stator 16 formed of the natural rubber cannot be used.

Table 4 shows a result of the experiment performed to examine a change in the maximum suction force PM according to a rotational frequency of the rotor 18. The maximum suction force PM is measured twice, namely, after one second and five seconds have elapsed since the rotor 18 is started. In the experiment, the rotors 18 formed of polycarbonate, and EPDM rubber are used.

As can be seen from Table 4, when the above-described powder pumps 1 are constructed such that the rotor 18 rotates at a frequency in a range of about 100 rpm to about 400 rpm, a suction force of the powder pump 1 is increased in a short period of time after the powder pump 1 starts to operate. Thus, a large amount of toner is conveyed to the developing device 3 while operating the powder pump 1 for a short period of time.

Figure 19:
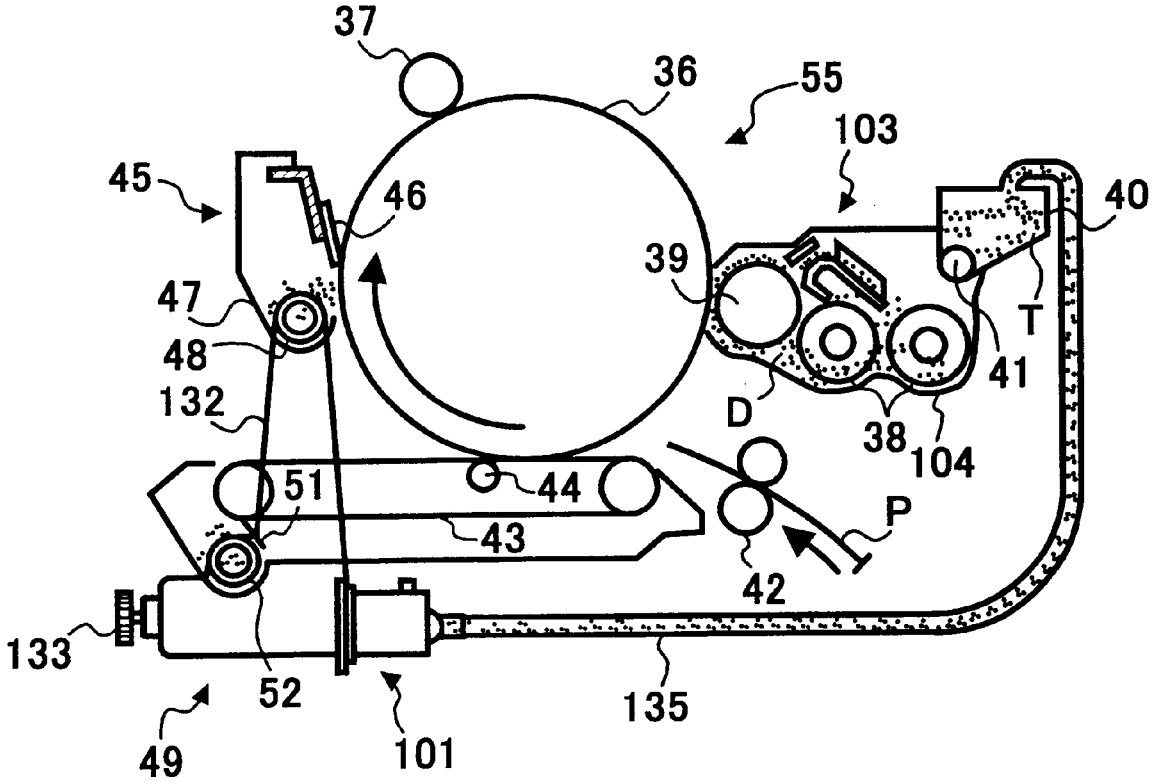
FIG. 19 is a drawing illustrating a partial sectional view of an image forming device and a recovery toner conveying device of an image forming apparatus.
Figure 20:
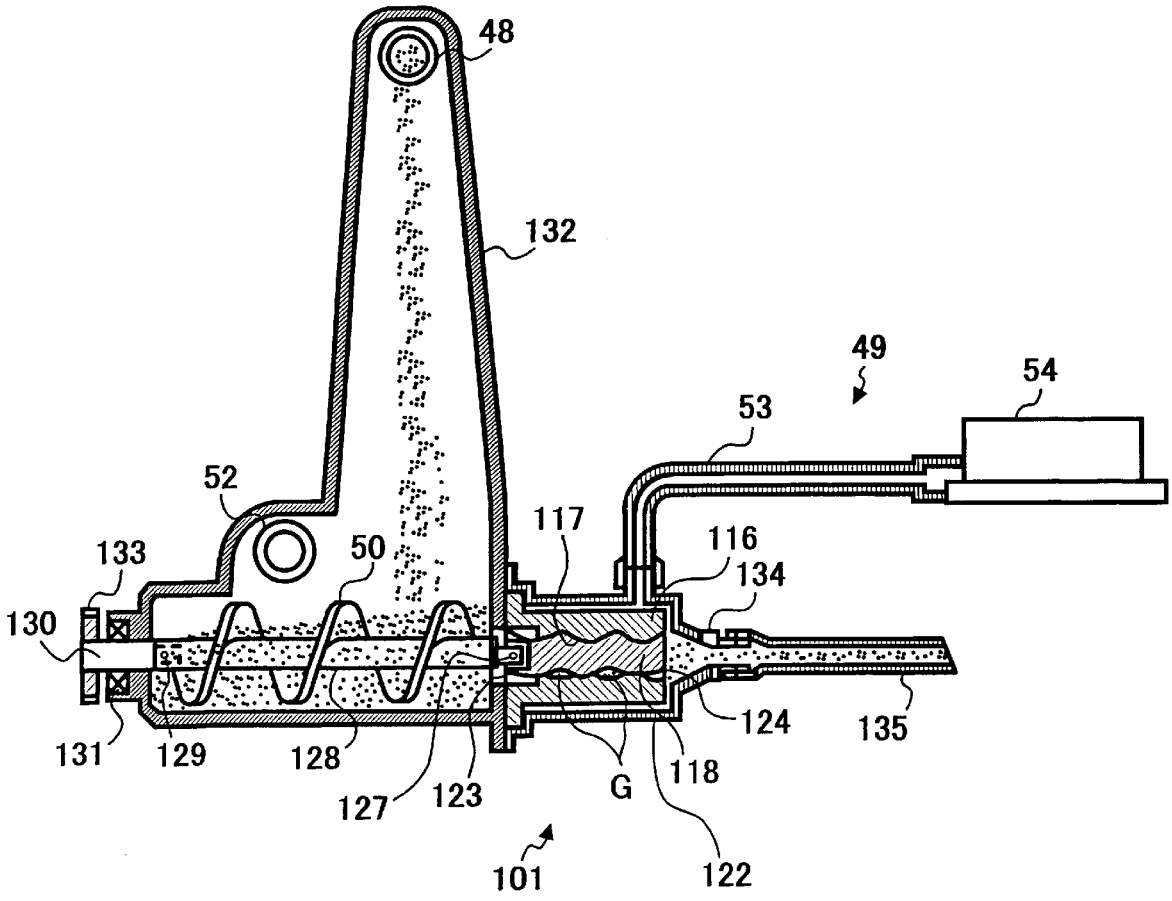
FIG. 20 is a drawing illustrating a sectional view of the recovery toner conveying device.

FIGS. 19 and 20 are drawings illustrating a recovery toner conveying device in which a powder pump is used. Toner recovered by a cleaning device is conveyed to the recovery toner conveying device so that the toner is recycled in a developing device. An image forming apparatus illustrated in FIG. 19 includes a photoconductive element 36 as an example of an image bearing member. The photoconductive element 36 is rotatably driven in a clockwise direction in FIG. 19. A charging roller 37 charges a surface of the photoconductive element 36. The surface of the photoconductive element 36 is irradiated with beam light reflected from an original document and modulated according to image data of the original document. Thus, an electrostatic latent image is formed on the surface of the photoconductive element 36. The electrostatic latent image is developed into a toner image by a developing device 103.

The developing device 103 includes a developer container 104, a stirring roller 38, a developing roller 39, and a toner container 40. The developer container 104 contains a two-component developer D that includes toner and a carrier. The stirring roller 38 stirs the developer D contained in the developer container 104. The developing roller 39 carries and conveys the developer D. The toner container 40 contains toner T that is supplied to the developer container 104. An electrostatic latent image is developed into a visible image with toner that is conveyed by the developing roller 39 to a developing region formed between the developing roller 39 and photoconductive element 36. When a sensor (not shown) detects that a toner density of the developer D contained in the developer container 104 is decreased, a toner supply roller 41 starts rotating to supply the developer D contained in the developer container 104 with the toner T contained in the toner container 40.

A transfer sheet P is fed from a sheet feeding device (not shown) to a pair of registration rollers 42. The pair of registration rollers 42 convey the transfer sheet P with a predetermined timing. The transfer sheet P is then conveyed by a transfer belt 43 so that a toner image formed on a surface of the photoconductive element 36 is transferred onto the transfer sheet P with a transfer voltage applied to a transfer roller 44.

The transfer sheet P conveyed by the transfer belt 43 of an image forming device 55 is then conveyed to a fixing device (not shown) where the toner image transferred onto the transfer sheet P is fixed by heat and pressure.

Residual toner remaining on a surface of the photoconductive element 36 is scraped by a cleaning blade 46 of a cleaning device 45. The residual toner conveyed to a cleaning case 47 of the cleaning device 45 is then conveyed toward a rear side in FIG. 19 by a coil screw 48. The residual toner drops in a duct-shaped casing 132 of a recovery toner conveying device 49 as illustrated in FIG. 20.

A cleaning blade 51 is brought into press-contact with the transfer belt 43 to scrape residual toner remaining on the transfer belt 43. The residual toner is conveyed to the casing 132 by a coil screw 52.

As illustrated in FIG. 20, the recovery toner conveying device 49 includes the casing 132, a powder pump 101 (see FIG. 21), and a toner conveying tube 135 which is, for example, formed of a flexible tube. The powder pump 101 includes a stator 116 and a rotor 118 that are identically constructed to the stator 16 and rotor 18, respectively which are described referring to FIGS. 1, 3 through 8, and 11. The stator 116 is held in a case 122. The rotor 118 is connected to a connecting shaft 128 through a pinjoint 127. The connecting shaft 128 is connected to a driving shaft 130 through a pin joint 129. The driving shaft 130 is rotatably supported by a casing 132 through a bearing 131. The driving shaft 130 is rotatably driven through a gear 133.

Figure 21:
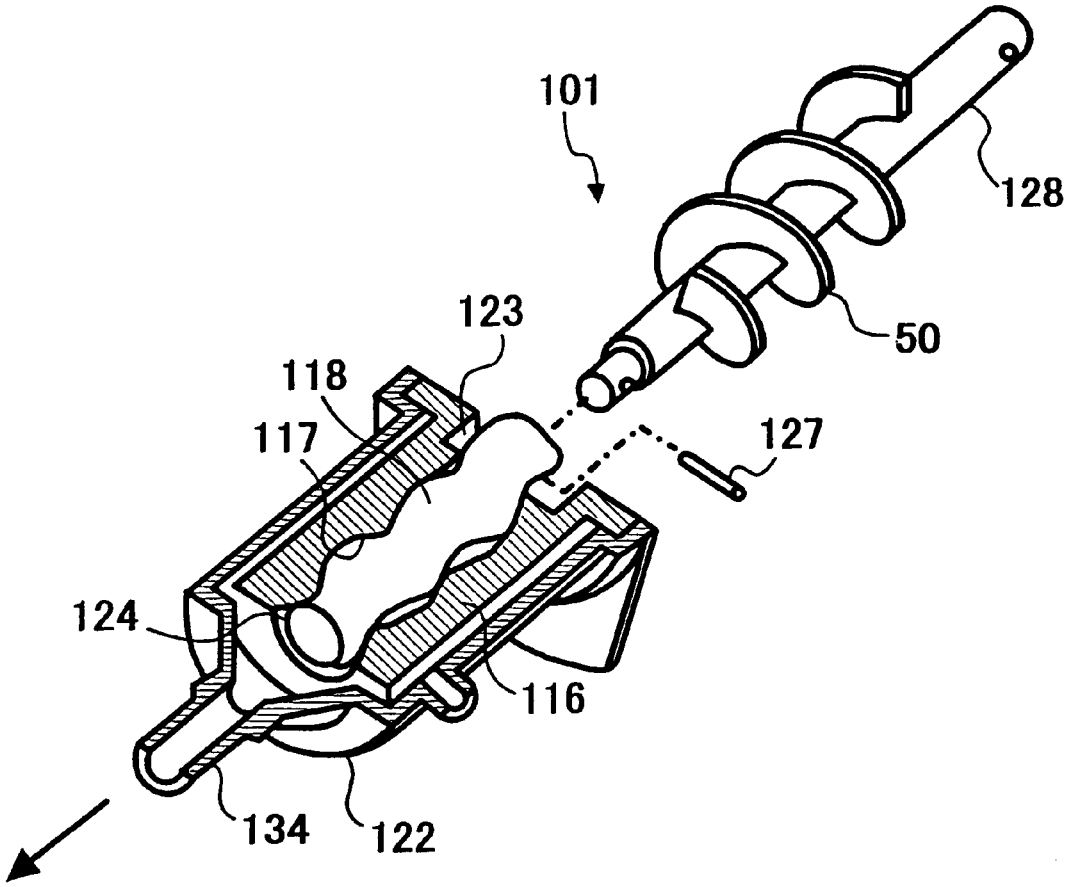
FIG. 21 is a drawing illustrating a sectional view of the powder pump illustrated in FIG. 17.

The powder pump 101 illustrated in FIGS. 20 and 21 differs from the powder pump 1 illustrated in FIG. 1 in the following way. Namely, the rotor 118 of the powder pump 101 rotates in the reverse direction of the rotor 18 illustrated in FIG. 1. Thus, the connecting shaft 128 is connected to an inlet opening 123 of a through hole 117 of the stator 116. An outlet opening 124 is provided at the other side of the stator 116. A powder outlet tube 134 is integrally connected to the case 122 on the side where toner is discharged. The powder pump 101 further differs from the powder pump 1 in the following way. Namely, the connecting shaft 128 includes an integrally constructed screw blade 50. The connecting shaft 128 acts as a screw conveyer. Air is supplied from an air pump 54 to a clearance created between the stator 116 and case 122 via an air supply tube 53. One end of a toner conveying tube 135 is connected to the powder outlet tube 134, and the other end of the toner conveying tube 135 is connected to the toner container 40 illustrated in FIG. 16.

When the connecting shaft 128 and rotor 118 are rotatably driven, toner that dropped onto the bottom of the casing 132 is conveyed by the screw blade 50 of the connecting shaft 128 toward the through hole 117 of the stator 116. Thus, a discharging force is generated in the powder outlet tube 134 on the side of the outlet opening 124 of the through hole 117. Toner taken into the cavity G is discharged out of the through hole 117 through the outlet opening 124. At this time, because air is supplied to the powder outlet tube 134 from the air pump 54, fluidity of the discharged toner is improved. The toner is then smoothly conveyed to a toner container 40 of the developing device 103 through the toner conveying tube 135 with the discharging force of the powder pump 101.

Generally, toner recovered from a photoconductive element or a transfer belt has a low level of fluidity. Because a powder pump is configured to handle such toner, even the recovery toner can be effectively conveyed.

Figure 22:
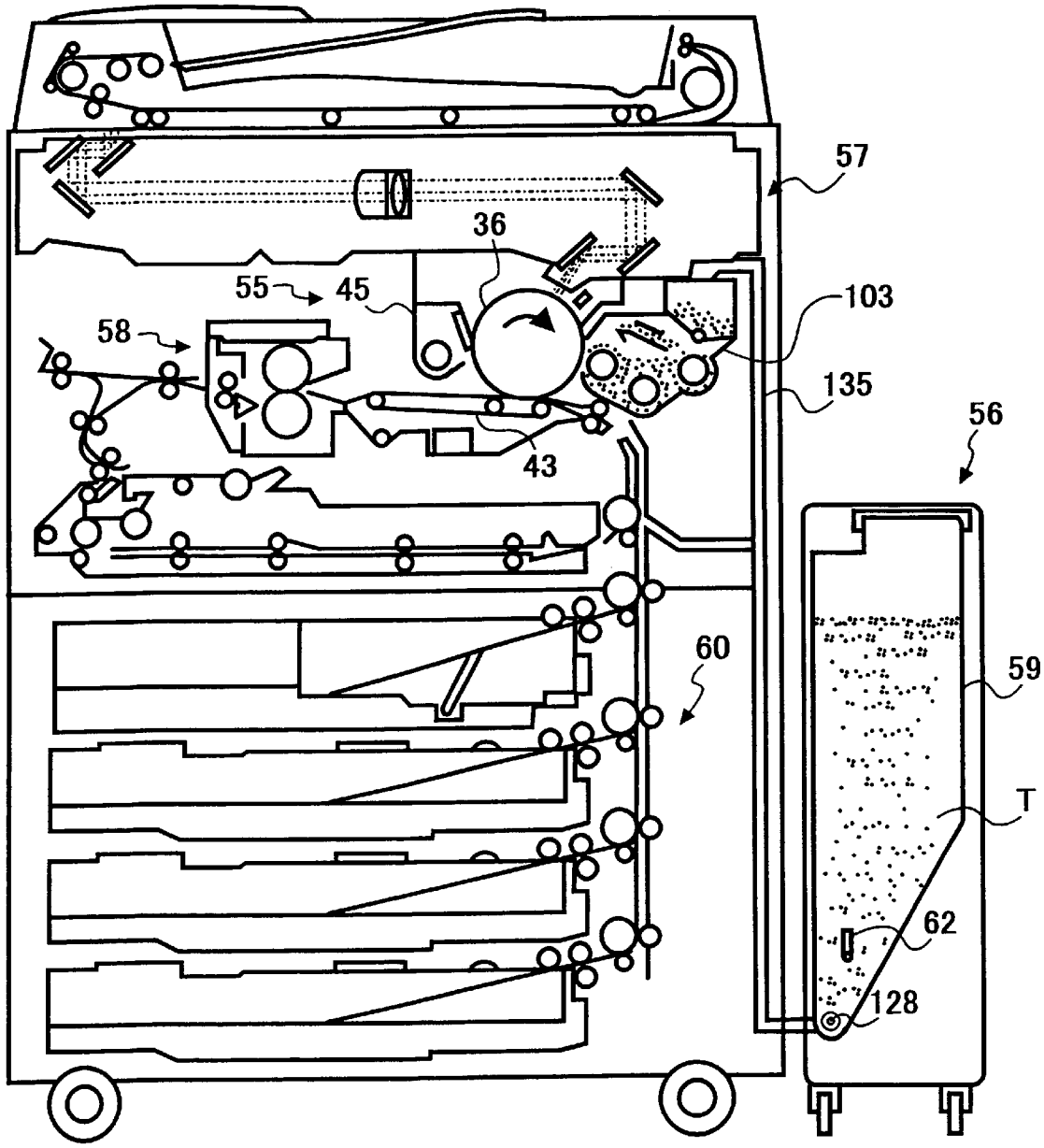
FIG. 22 is a schematic drawing illustrating an image forming apparatus to which a large-capacity toner replenishing device 56 is installed.
Figure 23:
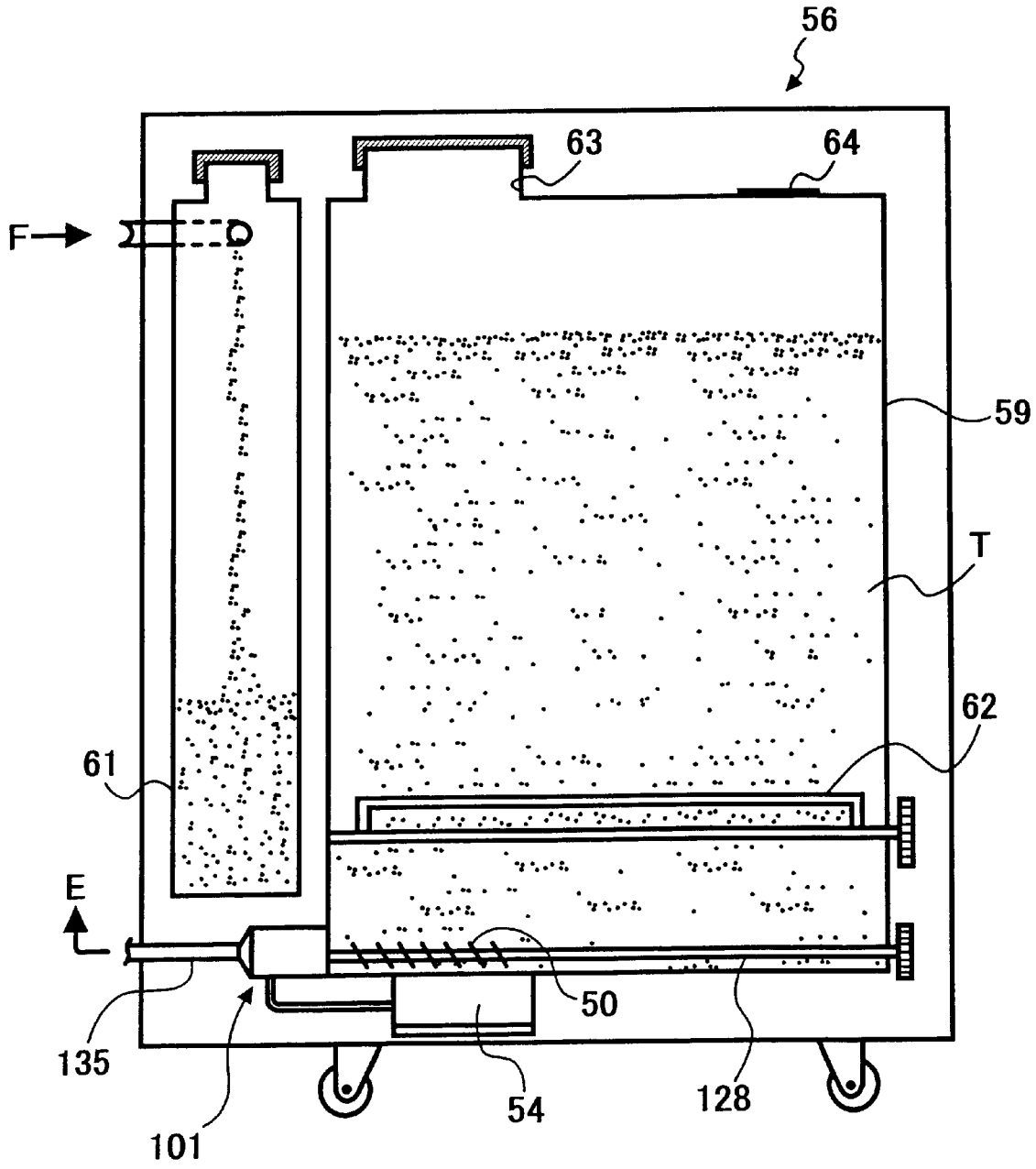
FIG. 23 is a schematic drawing illustrating the large-capacity toner replenishing device 56.

FIG. 22 is a schematic drawing illustrating an image forming apparatus to which a large-capacity toner replenishing device 56 is installed. FIG. 23 is a schematic drawing illustrating the large-capacity toner replenishing device 56. The image forming apparatus illustrated in FIG. 22 includes an original document reading device 57, the image forming device 55, a sheet feeding device 60, and a fixing device 58. The image forming device 55 is arranged at a position below the original document reading device 57. The sheet feeding device 60 is arranged at a position below the image forming device 55. The fixing device 58 fixes a toner image formed by the image forming device 55 and transferred onto a transfer sheet. The toner T contained in a toner containing tank 59 of the large-capacity toner replenishing device 56 is supplied to a developing device 103 of the image forming device 55. Toner recovered from the photoconductive element 36 and transfer belt 43 is conveyed to a recovery toner container 61 illustrated in FIG. 23 by the recovery toner conveying device 49 (see FIGS. 19 and 20). As other construction of the image forming device 55 may be identical to that illustrated in FIG. 19, an explanation is omitted.

As illustrated in FIG. 23, the toner T contained in the toner containing tank 59 is stirred by an agitator 62 provided at a lower portion of the toner containing tank 59. The toner T is discharged out of the toner containing tank 59 by the powder pump 101. The toner T is then conveyed to the developing device 103 through a toner conveying tube 135 as indicated by an arrow "E." The powder pump 101 illustrated in FIG. 23 is constructed identically to the powder pump 101 illustrated in FIGS. 20 and 21. The toner T contained in the toner containing tank 59 is conveyed to a cavity created between a stator and a rotor of the powder pump 101 by the screw blade 50 of the connecting shaft 128. Fluidity of the toner T discharged from the cavity is improved by air supplied from the air pump 54.

When the toner T contained in the toner containing tank 59 is exhausted, toner is replenished through a toner supply opening 63 provided on the top of the toner containing tank 59. At this time, air in the toner containing tank 59 is discharged out of the toner containing tank 59 through an air vent filter 64.

The recovery toner container 61 is used to supply the toner containing tank 59 with toner. An emptied recovery toner container 61 after the toner has been replenished to the toner containing tank 59 is used as the recovery toner container 61. Toner recovered from the cleaning device 45 and transfer belt 43 illustrated in FIG. 22 is conveyed to the recovery toner container 61 as illustrated by an arrow F in FIG. 23 through a toner conveying tube (not shown).

The large-capacity toner replenishing device 56 is generally installed as an optional device on a request from an user. The user who requires the large-capacity toner replenishing device 56 frequently uses the large-capacity toner replenishing device 56. Thus, the large-capacity toner replenishing device 56 having the above-described long-life powder pump is advantageous to the user. The large-capacity toner replenishing device 56 may be installed in a main body of the image forming apparatus as a standard device.

It is preferable that a powder pump is downsized when providing the powder pump to a main body of an image forming apparatus so as to downsize the image forming apparatus. When the above-described radius SR is set at a value not greater than 15 mm, the powder pump is downsized. However, a rotational frequency of a rotor of the powder pump should be increased so that the downsized powder pump can convey a desired amount of powder, for example, toner. Thus, high durability is required for the powder pump, however, if the powder pump is constructed as described above, the requirement is satisfied.

Examples of the powder pumps 1 and 101 that convey the toner T are described above. However, the present invention may also be generally applied to a powder pump that conveys a powder, such as two-component developer including toner and a carrier, and a developer including only the carrier, or any other types of powder. The present invention may be further applied to a powder pump used in an apparatus other than an image forming apparatus.

Obviously, numerous additional modifications and variations of the present invention are possible in light of the above teachings. It is therefore to be understood that within the scope of the appended claims, the present invention may be practiced otherwise than as specifically described herein.

TABLE 1

| STATOR NAME | SN/2SR | RUBBER HARDNESS | MAXIMUM SUCTION FORCE PM(KPa) IN EARLY STAGE | MAXIMUM SUCTION FORCE PM(KPa) AFTER 50 HOURS | JUDGMENT |
|---|---|---|---|---|---|
| A | 1 | 40 | 29 | 2 | X |
| B | 0.95 | 40 | 33 | 10 | ○ |
| C | 0.93 | 40 | 35 | 12 | ○ |
| D | 0.9 | 40 | 31 | 5 | Δ |
| E | 0.93 | 50 | 35 | 6 | Δ |
| F | 0.8 | 40 | 27 | 0 | X |

TABLE 2

| ROTOR MATERIAL | MAXIMUM SUCTION FORCE PM(KPa) IN EARLY STAGE | MAXIMUM SUCTION FORCE PM(KPa) AFTER 30 HOURS | JUDGMENT |
|---|---|---|---|
| ALUMINUM | 33 | 13 | ○ |
| POLYCARBONATE | 35 | 7 | Δ |
| POLYCARBONATE (WITH FLUORINE) | 30 | 13 | ○ |
| POLYCARBONATE TEFLON COATING | 38 | 7 | Δ |
| POLYACETAL RESIN | 30 | 6 | Δ |
| ABS RESIN | 34 | 0 | X |
| ABS RESIN Ni COATING | 37 | 2 | X |

TABLE 3

| STATOR MATERIAL | MAXIMUM SUCTION FORCE PM(Kpa) IN EARLY STAGE | MAXIMUM SUCTION FORCE PM(KPa) AFTER 30 HOURS | JUDGMENT |
|---|---|---|---|
| EPDM HARDNESS 40-DEGREE | 31 | 10 | ○ |
| EPDM HARDNESS 50-DEGREE | 41 | 5 | Δ |
| EPDM HARDNESS 60-DEGREE | 32 | 0 | X |
| CHLOROPRENE RUBBER HARDNESS 40-DEGREE | 30 | 12.2 | ○ |
| CHLOROPRENE RUBBER HARDNESS 50-DEGREE | 30 | 8.6 | Δ |
| CHLOROPRENE RUBBER HARDNESS 60-DEGREE | 37 | 0 | X |
| NATURAL RUBBER HARDNESS 40-DEGREE | 30 | 0 | X |

TABLE 4

| ROTOR ROTATIONAL FREQUENCY (rpm) | MAXIMUM SUCTION FORCE PM(KPa) AFTER ONE SECOND | MAXIMUM SUCTION FORCE PM(KPa) AFTER FIVE SECONDS |
|---|---|---|
| 50 | 1.1 | 6 |
| 90 | 2.7 | 14 |
| 100 | 3 | 14.5 |
| 200 | 7 | 27 |

TABLE 4-continued

| ROTOR ROTATIONAL FREQUENCY (rpm) | MAXIMUM SUCTION FORCE PM(KPa) AFTER ONE SECOND | MAXIMUM SUCTION FORCE PM(KPa) AFTER FIVE SECONDS |
|---|---|---|
| 300 | 10 | 33 |
| 400 | 16 | 34 |

What is claimed as new and is desired to be secured by Letters Patent of the United States:

1. A powder pump, comprising:

a stator comprised of a through hole, the through hole comprising two spirally extended grooves; and a rotor rotatably provided to the through hole of the stator and spirally extended such that a cavity to convey a powder is formed between an outer peripheral surface of the rotor and an inner peripheral surface of the through hole of the stator, the rotor being configured to convey the powder enclosed in the cavity while moving the cavity, wherein $(RA-SN \geqq 0.45)$,and $(RB-(SN+SX)/2) \geqq 0.45)$ are satisfied when a diameter of a cross section of the rotor, an outer diameter of the rotor, a minimum inner diameter of the through hole of the stator, and a maximum inner diameter of the through hole of the stator are in millimeters and represented by RA, RB, SN, and SX, respectively.

2. The powder pump according to claim 1, wherein $(RA-SN \leqq 0.9)$ and $((RB-(SN+SX)/2) \leqq 0.9)$ are satisfied.

3. The powder pump according to claim 1, wherein $((0.9 \leqq SN/2SR) \leqq 0.95)$ is satisfied when a radius of each groove of the through hole of the cross section of the stator is in millimeters and is represented by SR.

4. The powder pump according to claim 1, wherein the rotor is formed at least partially of at least one of aluminum, polycarbonate, and polyacetal resin.

5. The powder pump according to claim 1, wherein the stator is formed at least partially of at least one of one ethylene-propylene-diene-methylene rubber and chloroprene rubber having a hardness of 50-degree in Japanese Industrial Standards A.

6. The powder pump according to claim 1, wherein a rotational frequency of the rotor is set in a range from approximately 100 rpm to approximately 400 rpm.

7. The powder pump according to claim 1, wherein the powder to be conveyed comprises toner.

8. The powder pump according to claim 1, wherein the powder to be conveyed comprises a developer including toner and a carrier.

9. A powder pump, comprising:

a stator comprised of a through hole, the through hole comprising two spirally extended grooves; and a rotor rotatably provided to the through hole of the stator and spirally extended such that a cavity to convey a powder is formed between an outer peripheral surface of the rotor and an inner peripheral surface of the through hole of the stator, the rotor being configured to convey the powder enclosed in the cavity while moving the cavity, wherein $(-0.18 \leqq (RB-SN+SX)/2-(RA-SN)) \leqq 0.16)$ is satisfied when a diameter of a cross section of the rotor, an outer diameter of the rotor, a minimum inner diameter of the through hole of the stator, and a maximum inner diameter of the through hole of the stator are in millimeters and represented by RA, RB, SN, and SX, respectively.

10. The powder pump according to claim 9, wherein $((RA-SN) \leqq 0.9)$ and $((RB-(SN+SX)/2) \leqq 0.9)$ are satisfied.

11. The powder pump according to claim 9, wherein $(0.9 \leqq SN/2SR \leqq 0.95)$ is satisfied when a radius of each groove of the through hole of the cross section of the stator is in millimeters and represented by SR.

12. The powder pump according to claim 9, wherein the rotor is formed at least partially of at least one of aluminum, polycarbonate, and polyacetal resin.

13. The powder pump according to claim 9, wherein the stator is formed at least partially of at least one of ethylene-propylene-diene-methylene rubber and chloroprene rubber having a hardness of 50-degree in Japanese Industrial Standards A.

14. The powder pump according to claim 9, wherein a rotational frequency of the rotor is set in a range from approximately 100 rpm to approximately 400 rpm.

15. The powder pump according to claim 9, wherein the powder to be conveyed comprises toner.

16. The powder pump according to claim 9, wherein the powder to be conveyed comprises a developer including toner and a carrier.

17. A powder pump, comprising:

a stator comprised of a through hole, the through hole comprising two spirally extended grooves; and a rotor rotatably provided to the through hole of the stator and spirally extended such that a cavity to convey a powder is formed between an outer peripheral surface of the rotor and an inner peripheral surface of the through hole of the stator, the rotor being configured to convey the powder enclosed in the cavity while moving the cavity, wherein $(RA-SN \geqq 0.4)$, $(RB-(SN+SX)/2 \geqq 0.4)$, and $(-0.18 \leqq (RB-(SN+SX)/2-(RA-SN)) \leqq 0.12)$ are satisfied when a diameter of a cross section of the rotor, an outer diameter of the rotor, a minimum inner diameter of the through hole of the stator, and a maximum inner diameter of the through hole of the stator are in millimeters and represented by RA, RB, SN, and SX, respectively.

18. The powder pump according to claim 17, wherein $((RA-SN) \leqq 0.9)$ and $((RB-(SN+SX)/2) \leqq 0.9)$ are satisfied.

19. The powder pump according to claim 17, wherein $(0.9 \leqq (SN/2SR) \leqq 0.95)$ is satisfied when a radius of each groove of the through hole of the cross section of the stator is in millimeters and represented by SR.

20. The powder pump according to claim 17, wherein the rotor is formed at least partially of at least one of aluminum, polycarbonate, and polyacetal resin.

21. The powder pump according to claim 17, wherein the stator is formed at least partially of at least one of ethylene-propylene-diene-methylene rubber and chloroprene rubber having a hardness of 50-degree in Japanese Industrial Standards A.

22. The powder pump according to claim 17, wherein a rotational frequency of the rotor is set in a range from approximately 100 rpm to approximately 400 rpm.

23. The powder pump according to claim 17, wherein the powder to be conveyed comprises toner.

24. The powder pump according to claim 17, wherein the powder to be conveyed comprises a developer including toner and a carrier.

25. A powder pump, comprising:

a stator comprised of a through hole, the through hole comprising two spirally extended grooves; and a rotor rotatably provided to the through hole of the stator and spirally extended such that a cavity to convey a powder is formed between an outer peripheral surface of the rotor and an inner peripheral surface of the through hole of the stator, the rotor being configured to convey the powder enclosed in the cavity while moving the cavity, wherein $(RA-SN \geqq 0.5)$, $((RB-(SN+SX)/2) \geqq 0.5)$, and $(-0.18 \leqq (RB-(SN+SX)/2-(RA-SN)) \leqq 0.12)$ are satisfied when a diameter of a cross section of the rotor, an outer diameter of the rotor, a minimum inner diameter of the through hole of the stator, and a maximum inner diameter of the through hole of the stator are in millimeters and represented by RA, RB, SN, and SX, respectively.

26. The powder pump according to claim 25, wherein $((RA-SN) \leqq 0.9)$ and $((RB-(SN+SX)/2) \leqq 0.9)$ are satisfied.

27. The powder pump according to claim 25, wherein $(0.9 \leqq (SN/2SR) \leqq 0.95)$ is satisfied when a radius of each groove of the through hole of the cross section of the stator is in millimeters and represented by SR.

28. The powder pump according to claim 25, wherein the rotor is formed at least partially of at least one of aluminum, polycarbonate, and polyacetal resin.

29. The powder pump according to claim 25, wherein the stator is formed at least partially of at least one of ethylene-propylene-diene-methylene rubber and chloroprene rubber having a hardness of 50-degree in Japanese Industrial Standards A.

30. The powder pump according to claim 25, wherein a rotational frequency of the rotor is set in a range from approximately 100 rpm to approximately 400 rpm.

31. The powder pump according to claim 25, wherein the powder to be conveyed comprises toner.

32. The powder pump according to claim 25, wherein the powder to be conveyed comprises a developer including toner and a carrier.

33. A powder pump, comprising:

a stator comprised of a through hole, the through hole comprising two spirally extended grooves; and a rotor rotatably provided to the through hole of the stator and spirally extended such that a cavity to convey a powder is formed between an outer peripheral surface of the rotor and an inner peripheral surface of the through hole of the stator, the rotor being configured to convey the powder enclosed in the cavity while moving the cavity, wherein $(0.9 \leqq (SN/2SR) \leqq 0.95)$ is satisfied when a minimum inner diameter of the through hole of the stator, and a radius of each groove of the through hole of a cross section of the stator are in millimeters and represented by SN, and SR, respectively.

34. The powder pump according to claim 33, wherein the rotor is formed at least partially of at least one of aluminum, polycarbonate, and polyacetal resin.

35. The powder pump according to claim 33, wherein the stator is formed at least partially of at least one of ethylene-propylene-diene-methylene rubber and chloroprene rubber having a hardness of 50-degree in Japanese Industrial Standards A.

36. The powder pump according to claim 33, wherein a rotational frequency of the rotor is set in a range from approximately 100 rpm to approximately 400 rpm.

37. The powder pump according to claim 33, wherein the powder to be conveyed comprises toner.

38. The powder pump according to claim 33, wherein the powder to be conveyed comprises a developer including toner and a carrier.

39. An image forming apparatus, comprising:

an image bearing member on which an electrostatic latent image is formed; and a powder pump comprising:

a stator comprised of a through hole, the through hole comprising two spirally extended grooves, and a rotor rotatably provided to the through hole of the stator and spirally extended such that a cavity to convey a powder is formed between an outer peripheral surface of the rotor and an inner peripheral surface of the through hole of the stator, the rotor being configured to convey toner enclosed in the cavity while moving the cavity, wherein $(RA-SN \geqq 0.45)$, and $(RB-(SN+SX)/2 \geqq 0.45)$ are satisfied when a diameter of a cross section of the rotor, an outer diameter of the rotor, a minimum inner diameter of the through hole of the stator, and a maximum inner diameter of the through hole of the stator are in millimeters are represented by RA, RB, SN, and SX, respectively.

40. An image forming apparatus, comprising:

an image bearing member on which an electrostatic latent image is formed; and a powder pump comprising:

a stator comprised of a through hole, the through hole comprising two spirally extended grooves, and a rotor rotatably provided to the through hole of the stator and spirally extended such that a cavity to convey a powder is formed between an outer peripheral surface of the rotor and an inner peripheral surface of the through hole of the stator, the rotor being configured to convey toner enclosed in the cavity while moving the cavity, wherein $(-0.18 \leqq RB-(SN+SX)/2-(RA-SN) \leqq 0.16)$ is satisfied when a diameter of a cross section of the rotor, an outer diameter of the rotor, a minimum inner diameter of the through hole of the stator, and a maximum inner diameter of the through hole of the stator are in millimeters and represented by RA, RB, SN, and SX, respectively.

41. An image forming apparatus, comprising:

an image bearing member on which an electrostatic latent image is formed; and a powder pump comprising:

a stator comprised of a through hole, the through hole comprising two spirally extended grooves, and a rotor rotatably provided to the through hole of the stator and spirally extended such that a cavity to convey a powder is formed between an outer peripheral surface of the rotor and an inner peripheral surface of the through hole of the stator, the rotor being configured to convey toner enclosed in the cavity while moving the cavity, wherein $(RA-SN \geqq 0.4)$, $(RB-(SN+SX)/2 \geqq 0.4)$, and $(-0.18 \leqq RB-SN+SX)/2-(RA-SN) \leqq 0.12)$ are satisfied when a diameter of a cross section of the rotor, an outer diameter of the rotor, a minimum inner diameter of the through hole of the stator, and a maximum inner diameter of the through hole of the stator are in millimeters and represented by RA, RB, SN, and SX, respectively.

42. An image forming apparatus, comprising:

an image bearing member on which an electrostatic latent image is formed; and a powder pump comprising:

a stator comprised of a through hole, the through hole comprising two spirally extended grooves, and a rotor rotatably provided to the through hole of the stator and spirally extended such that a cavity to convey a powder is formed between an outer peripheral surface of the rotor and an inner peripheral surface of the through hole of the stator, the rotor being configured to convey toner enclosed in the cavity while moving the cavity, wherein $(RA-SN \geqq 0.5)$, $(RB-(SN+SX)/2 \geqq 0.5)$, and $(-0.18 \leqq RB-(SN+SX)/2-(RA-SN) \leqq 0.12)$ are satisfied when a diameter of a cross section of the rotor, an outer diameter of the rotor, a minimum inner diameter of the through hole of the stator, and a maximum inner diameter of the through hole of the stator are in millimeters and represented by RA, RB, SN, and SX, respectively.

43. An image forming apparatus, comprising:

an image bearing member on which an electrostatic latent image is formed; and a powder pump comprising:

a stator comprised of a through hole, the through hole comprising two spirally extended grooves, and a rotor rotatably provided to the through hole of the stator and spirally extended such that a cavity to convey a powder is formed between an outer peripheral surface of the rotor and an inner peripheral surface of the through hole of the stator, the rotor being configured to convey toner enclosed in the cavity while moving the cavity, wherein $(0.9 \leqq (SN/2SR) \leqq 0.95)$ is satisfied when a minimum inner diameter of the through hole of the stator, and a radius of each groove of the through hole of a cross section of the stator are in millimeters and represented by SN, and SR, respectively.

44. An image forming apparatus, comprising: an image bearing member on which an electrostatic latent image is formed; and a powder pump comprising:

a stator comprised of a through hole, the through hole comprising two spirally extended grooves, and a rotor rotatably provided to the through hole of the stator and spirally extended such that a cavity to convey a powder is formed between an outer peripheral surface of the rotor and an inner peripheral surface of the through hole of the stator, the rotor being configured to convey a developer including toner and a carrier enclosed in the cavity while moving the cavity, wherein $((RA-SN) \geqq 0.45)$ and $((RB-(SN+SX)/2) \geqq 0.45)$ are satisfied when a diameter of a cross section of the rotor, an outer diameter of the rotor, a minimum inner diameter of the through hole of the stator, and a maximum inner diameter of the through hole of the stator are in millimeters and represented by RA, RB, SN, and SX, respectively.

45. An image forming apparatus, comprising:

an image bearing member on which an electrostatic latent image is formed; and a powder pump comprising:

a stator comprised of a through hole, the through hole comprising two spirally extended grooves, and a rotor rotatably provided to the through hole of the stator and spirally extended such that a cavity to convey a powder is formed between an outer peripheral surface of the rotor and an inner peripheral surface of the through hole of the stator, the rotor being configured to convey a developer including toner and a carrier enclosed in the cavity while moving the cavity, wherein $(-0.18 \leqq (RB-(SN+SX)/2-(RA-SN)) \leqq 0.16)$ is satisfied when a diameter of a cross section of the rotor, an outer diameter of the rotor, a minimum inner diameter of the through hole of the stator, and a maximum inner diameter of the through hole of the stator are in millimeters and represented by RA, RB, SN, and SX, respectively.

46. An image forming apparatus, comprising:

an image bearing member on which an electrostatic latent image is formed; and a powder pump comprising:

a stator comprised of a through hole, the through hole comprising two spirally extended grooves, and a rotor rotatably provided to the through hole of the stator and spirally extended such that a cavity to convey a powder is formed between an outer peripheral surface of the rotor and an inner peripheral surface of the through hole of the stator, the rotor being configured to convey a developer including toner and a carrier enclosed in the cavity while moving the cavity, wherein $(RA-SN \geqq 0.4)$, $((RB-(SN+SX)/2) \geqq 0.4)$, and $(-0.18 \leqq (RB-(SN+SX)/2-(RA-SN)) \leqq 0.12)$ are satisfied when a diameter of a cross section of the rotor, an outer diameter of the rotor, a minimum inner diameter of the through hole of the stator, and a maximum inner diameter of the through hole of the stator are in millimeters and represented by RA, RB, SN, and SX, respectively.

47. An image forming apparatus, comprising:

an image bearing member on which an electrostatic latent image is formed; and a powder pump comprising:

a stator comprised of a through hole, the through hole comprising two spirally extended grooves, and a rotor rotatably provided to the through hole of the stator and spirally extended such that a cavity to convey a powder is formed between an outer peripheral surface of the rotor and an inner peripheral surface of the through hole of the stator, the rotor being configured to convey a developer including toner and a carrier enclosed in the cavity while moving the cavity, wherein $((RA-SN) \geqq 0.5)$, $((RB-(SN+SX)/2) \geqq 0.5)$, and $(-0.18 \leqq (RB-(SN+SX)/2-(RA-SN)) \leqq 0.12)$ are satisfied when a diameter of a cross section of the rotor, an outer diameter of the rotor, a minimum inner diameter of the through hole of the stator, and a maximum inner diameter of the through hole of the stator are in millimeters and represented by RA, RB, SN, and SX, respectively.

48. An image forming apparatus, comprising:

an image bearing member on which an electrostatic latent image is formed; and a powder pump comprising:

a stator comprised of a through hole, the through hole comprising two spirally extended grooves, and a rotor rotatably provided to the through hole of the stator and spirally extended such that a cavity to convey a powder is formed between an outer peripheral surface of the rotor and an inner peripheral surface of the through hole of the stator, the rotor being configured to convey a developer including toner and a carrier enclosed in the cavity while moving the cavity, wherein $(0.9 \leqq (SN/2SR) \leqq 0.95)$ is satisfied when a minimum inner diameter of the through hole of the stator, and a radius of each groove of the through hole of a cross section of the stator are in millimeters and represented by SN, and SR, respectively.

49. A powder pump, comprising:

a stator comprised of a through hole, the through hole comprising two spirally extended grooves; and a rotor means rotatably provided to the through hole of the stator and spirally extended such that a cavity to convey a powder is formed between an outer peripheral surface of the rotor and an inner peripheral surface of the through hole of the stator, for conveying the powder enclosed in the cavity while moving the cavity, wherein $((RA-SN) \geqq 0.45)$ and $((RB-(SN+SX)/2) \geqq 0.45)$ are satisfied when a diameter of a cross section of the rotor means, an outer diameter of the rotor means, a minimum inner diameter of the through hole of the stator, and a maximum inner diameter of the through hole of the stator are in millimeters and represented by RA, RB, SN, and SX, respectively.

50. A powder pump, comprising:

a stator comprised of a through hole, the through hole comprising two spirally extended grooves; and a rotor means rotatably provided to the through hole of the stator and spirally extended such that a cavity to convey a powder is formed between an outer peripheral surface of the rotor and an inner peripheral surface of the through hole of the stator, for conveying the powder enclosed in the cavity while moving the cavity, wherein $(-0.18 \leqq (RB-(SN+SX)/2-(RA-SN)) \leqq 0.16)$ is satisfied when a diameter of a cross section of the rotor means, an outer diameter of the rotor means, a minimum inner diameter of the through hole of the stator, and a maximum inner diameter of the through hole of the stator are in millimeters and represented by RA, RB, SN, and SX, respectively.

51. A powder pump, comprising:

a stator comprised of a through hole, the through hole comprising two spirally extended grooves; and a rotor means rotatably provided to the through hole of the stator and spirally extended such that a cavity to convey a powder is formed between an outer peripheral surface of the rotor and an inner peripheral surface of the through hole of the stator, for conveying the powder enclosed in the cavity while moving the cavity, wherein $((RA-SN) \geqq 0.4)$, $((RB-(SN+SX)/2) \geqq 0.4)$, and $(-0.18 \leqq (RB-(SN+SX)/2-(RA-SN)) \leqq 0.12)$ are satisfied when a diameter of a cross section of the rotor means, an outer diameter of the rotor means, a minimum inner diameter of the through hole of the stator, and a maximum inner diameter of the through hole of the stator are in millimeters and represented by RA, RB, SN, and SX, respectively.

52. A powder pump, comprising:

a stator comprised of a through hole, the through hole comprising two spirally extended grooves; and a rotor means rotatably provided to the through hole of the stator and spirally extended such that a cavity to convey a powder is formed between an outer peripheral surface of the rotor and an inner peripheral surface of the through hole of the stator, for conveying the powder enclosed in the cavity while moving the cavity, wherein $(RA-SN \geqq 0.5)$, $((RB-(SN+SX)/2) \geqq 0.5)$, and $(-0.18 \leqq (RB-(SN+SX)/2-(RA-SN)) \leqq 0.12)$ are satisfied when a diameter of a cross section of the rotor means, an outer diameter of the rotor means, a minimum inner diameter of the through hole of the stator, and a maximum inner diameter of the through hole of the stator are in millimeters and represented by RA, RB, SN, and SX, respectively.

53. A powder pump, comprising:

a stator comprised of a through hole, the through hole comprising two spirally extended grooves; and a rotor means rotatably provided to the through hole of the stator and spirally extended such that a cavity to convey a powder is formed between an outer peripheral surface of the rotor and an inner peripheral surface of the through hole of the stator, for conveying the powder enclosed in the cavity while moving the cavity, wherein $(0.9 \leqq (SN/2SR) \leqq 0.95)$ is satisfied when a minimum inner diameter of the through hole of the stator, and a radius of each groove of the through hole of a cross section of the stator are in millimeters and represented by SN, and SR, respectively.

54. A method for conveying a powder with a powder pump, comprising:

providing a stator comprised of a through hole having two spirally extended grooves; and providing a rotor rotatably provided to the through hole of the stator and spirally extended such that a cavity to convey a powder is formed between an outer peripheral surface of the rotor and an inner peripheral surface of the through hole of the stator, for conveying the powder enclosed in the cavity while moving the cavity, wherein $(RA-SN \geqq 0.45)$ and $(RB-(SN+SX)/2 \geqq 0.45)$ are satisfied when a diameter of a cross section of the rotor, an outer diameter of the rotor, a minimum inner diameter of the through hole of the stator, and a maximum inner diameter of the through hole of the stator are in millimeters and represented by RA, RB, SN, and SX, respectively.

55. A method for conveying a powder with a powder pump, comprising:

providing a stator comprised of a through hole having two spirally extended grooves; and providing a rotor rotatably provided to the through hole of the stator and spirally extended such that a cavity to convey a powder is formed between an outer peripheral surface of the rotor and an inner peripheral surface of the through hole of the stator, for conveying the powder enclosed in the cavity while moving the cavity, wherein $(-0.18 \leqq (RB-SN+SX)/2-(RA-SN)) \leqq 0.16)$ is satisfied when a diameter of a cross section of the rotor, an outer diameter of the rotor, a minimum inner diameter of the through hole of the stator, and a maximum inner diameter of the through hole of the stator are in millimeters and represented by RA, RB, SN, and SX, respectively.

56. A method for conveying a powder with a powder pump, comprising:

providing a stator comprising a through hole having two spirally extended grooves; and providing a rotor rotatably provided to the through hole of the stator and spirally extended such that a cavity to convey a powder is formed between an outer peripheral surface of the rotor and an inner peripheral surface of the through hole of the stator, for conveying the powder enclosed in the cavity while moving the cavity, wherein $(RA-SN \geqq 0.4)$, $((RB-(SN+SX)/2) \geqq 0.4)$, and $(-0.18 \leqq ((RB-(SN+SX)/2-(RA-SN))) \leqq 0.12)$ are satisfied when a diameter of a cross section of the rotor, an outer diameter of the rotor, a minimum inner diameter of the through hole of the stator, and a maximum inner diameter of the through hole of the stator are in millimeters and represented by RA, RB, SN, and SX, respectively.

57. A method for conveying a powder with a powder pump, comprising:

providing a stator comprised of a through hole having two spirally extended grooves; and providing a rotor rotatably provided to the through hole of the stator and spirally extended such that a cavity to convey a powder is formed between an outer peripheral surface of the rotor and an inner peripheral surface of the through hole of the stator, for conveying the powder enclosed in the cavity while moving the cavity, wherein $(RA-SN \geqq 0.5)$, $((RB-(SN+SX)/2) \geqq 0.5)$, and $(-0.18 \leqq (RB-(SN+SX)/2-(RA-SN)) \leqq 0.12)$ are satisfied when a diameter of a cross section of the rotor, an outer diameter of the rotor, a minimum inner diameter of the through hole of the stator, and a maximum inner diameter of the through hole of the stator are in millimeters and represented by RA, RB, SN, and SX, respectively.

58. A method for conveying a powder with a powder pump, comprising:

providing a stator comprised of a through hole having two spirally extended grooves; and providing a rotor rotatably provided to the through hole of the stator and spirally extended such that a cavity to convey a powder is formed between an outer peripheral surface of the rotor and an inner peripheral surface of the through hole of the stator, for conveying the powder enclosed in the cavity while moving the cavity, wherein $0.9 \leqq (SN/2SR) \leqq 0.95$ is satisfied when a minimum inner diameter of the through hole of the stator, and a radius of each groove of the through hole of a cross section of the stator are in millimeters and represented by SN, and SR, respectively.

59. A powder pump, comprising:

a stator comprised of a through hole comprising two spirally extended grooves, and means for conveying a maximum amount of powder within a cavity through increased hermeticity while moving the cavity, wherein the cavity is formed between an outer surface of the means for conveying and the stator, wherein $(RA-SN) \geqq 0.45$ and $(RB-(SN+SX)/2) \geqq 0.45$ are satisfied when a diameter of a cross section of the means for conveying, an outer diameter of the means for conveying, a minimum inner diameter of the through hole of the stator, and a maximum inner diameter of the through hole of the stator are in millimeters and are represented by RA, RB, SN, and SX, respectively.

60. The powder pump according to claim 59, further comprising means for deforming the stator, thereby increasing the contacting force of the stator on the means for conveying.

* * * * *